US007316221B2

(12) United States Patent
Imamura

(10) Patent No.: US 7,316,221 B2
(45) Date of Patent: Jan. 8, 2008

(54) VALVE SYSTEM OF V-TYPE ENGINE

(75) Inventor: Toshio Imamura, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/699,552

(22) Filed: Jan. 30, 2007

(65) Prior Publication Data

US 2007/0193541 A1 Aug. 23, 2007

(30) Foreign Application Priority Data

Feb. 21, 2006 (JP) ..... 2006-043787

(51) Int. Cl.
*F02M 37/06* (2006.01)

(52) U.S. Cl. ..... 123/505; 123/508; 123/495

(58) Field of Classification Search ..... 123/505, 123/508, 495, 90.17, 90.31, 90.6, 90.22
See application file for complete search history.

(56) References Cited

U.S. PATENT DOCUMENTS 6,550,455 B2 * 4/2003 Carroll et al. ..... 123/456
6,966,301 B2 * 11/2005 Knight et al. ..... 123/456
6,976,476 B1 * 12/2005 Mantri ..... 123/508
2002/0035989 A1 * 3/2002 Iitaka et al. ..... 123/509
2003/0168048 A1 * 9/2003 Koga et al. ..... 123/508
2004/0139939 A1 * 7/2004 Tsubouchi ..... 123/182.1

FOREIGN PATENT DOCUMENTS

JP A 10-176508 6/1998
JP A-2002-213326 1/2001
JP A 2002-213326 7/2002

* cited by examiner

*Primary Examiner*—Stephen K. Cronin
*Assistant Examiner*—Jason Benton
(74) *Attorney, Agent, or Firm*—Oliff & Berridge, PLC.

(57) ABSTRACT

A valve system of a V-type engine in which a camshaft provided in each bank is formed with valve cams that open and close engine valves and a pump cam for driving a fuel pump, the phase of the pump cam relative to the valve cams is set such that the crank angle at which driving torque of the pump cam is maximized does not coincide with the crank angle at which driving torque of each of the valve cams is maximized.

5 Claims, 11 Drawing Sheets

VALVE SYSTEM OF V-TYPE ENGINE

INCORPORATION BY REFERENCE

The disclosure of Japanese Patent Application No. 2006-043787 filed on Feb. 21, 2006, including the specification, drawings and abstract, is incorporated herein by reference in its entirety.

BACKGROUND OF THE INVENTION

1. Field of the Invention

The invention relates to a valve system of a V-type engine in which a camshaft provided in each bank of the engine is formed with valve cams for driving (i.e., opening and closing) engine valves and a pump cam for driving a fuel pump that feeds fuel under pressure to a fuel injection device.

2. Description of Related Art

There is known a valve system in which a fuel pump that delivers fuel under pressure to a fuel injection device is driven by a camshaft on which valve cams for driving (i.e., opening and closing) engine valves, such as the intake valves or the exhaust valves, are formed. In the known valve system, a piston of the fuel pump is urged by a spring, or the like, into contact with a pump cam formed on the camshaft, so that rotating the pump cam causes the piston to reciprocate in the fuel pump, namely, the pump cam drives the piston as it rotates with the camshaft. With the piston thus reciprocating, the fuel is drawn from the fuel tank into the fuel pump, and is then pressurized and fed to the fuel injection device. Meanwhile, the camshaft on which the pump cam as well as the valve cams are formed is subjected to torque fluctuations in driving the fuel pump, in addition to torque fluctuations in driving the engine valves. If the driving torque fluctuations associated with the fuel pump are superimposed on those associated with the engine valves to increase the amplitude of total torque fluctuations, excessive tension is applied to a drive member, such as a timing belt or a timing chain, for driving the camshaft, which may result in a reduction of the service life of the drive member. In view of this situation, a valve system has been proposed in which the phase relationship (i.e., relationship in the angular position) between the valve cams and the pump cam is set to suppress or reduce fluctuations in driving torque experienced by the camshaft, as disclosed in, for example, JP-A-H10-176508. The publication also discloses an example of a V-type six-cylinder engine in which the valve system as described just above is applied to a camshaft provided in each bank.

In the V-type six-cylinder engine as disclosed in the above-identified publication, crank-angle phase differences among the cylinders provided in each bank are set at equal intervals, namely, the pistons of the cylinders in each bank move with equal phase shifts in terms of the crank angle during operation of the engine. Therefore, torque fluctuations in driving the engine valves occur in substantially the same form at regular intervals while the camshaft makes one revolution or while the crankshaft makes two revolutions. It is, therefore, relatively easy to set the phase (angular position) of the pump cam with respect to the valve cams to suppress the driving torque fluctuations arising in the camshaft. In some types of V-type engines, such as a V-type eight-cylinder engine, however, crank-angle phase differences among the cylinders in each bank may not be set at equal intervals. In such cases, the camshaft of each bank is subjected to a complicated form of torque fluctuations in driving the engine valves, which makes it difficult to appropriately set the timing and frequency of driving the fuel pump.

SUMMARY OF THE INVENTION

The invention provides a valve system of a V-type engine, in which a camshaft for driving a fuel pump as well as engine valves is subjected to reduced driving torque fluctuations.

According to one aspect of the invention, a valve system of a V-type engine in which a camshaft provided in each bank of the engine is formed with valve cams that opens and closes engine valves and a pump cam that drives a fuel pump, which feeds fuel pressurized fuel to a fuel injection device. In addition, the crank-angle phase differences among cylinders in each bank of the V-type engine are set at unequal intervals. In the valve system, the pump cam has a plurality of cam noses, and the phase of the pump cam relative to the valve cams is determined such that a crank angle at which driving torque of the pump cam is maximized does not coincide with a crank angle at which driving torque of each of the valve cams is maximized.

With the above arrangement, even when the crank-angle phase difference among the cylinders in each bank are set at unequal intervals, and the camshaft of each bank is subjected to a complicated form of torque fluctuations in driving the engine valves, the maximum value of the driving torque applied to the camshaft is reduced, and fluctuations in the driving torque of the camshaft is suppressed. This makes it possible to reduce the maximum tension and fluctuations in the tension applied to a drive member, such as a timing belt, that drives the camshaft, thus avoiding an otherwise possible reduction of the service life of the drive member.

In the valve system as described above, the pump cam having a plurality of cam noses drives the fuel pump at least two times during one rotation of the camshaft. This arrangement reduces the amount of driving torque required each time for driving the fuel pump, thus further reducing the fluctuations in the driving torque of the camshaft.

In a first embodiment of the above aspect of the invention, the V-type engine has four cylinders in each bank, and crank-angle phase differences between the cylinders of the engine are set at equal intervals of 90° CA, while crank-angle phase differences between the cylinders in each bank are set at unequal intervals including 90° CA and 270° CA. In this valve system, the pump cam of each bank has two cam noses that are formed in the same shape at equal intervals over the entire circumference of the pump cam, and the pump cams of the two banks are arranged to drive the corresponding fuel pump in phase with each other. The phase of the pump cam relative to the valve cams is determined in terms of the crank angle such that the phase in which a top of one of the cam noses of the pump cam acts on the fuel pump is advanced by an angle within a range of 120° CA to 180° CA from the phase in which a top of a cam nose of one of the valve cams for driving the corresponding engine valve of a specified cylinder of the engine acts on an actuator linked to the engine valve, the specified cylinder being located in the bank in which the pump cam is provided and providing a crank-angle phase difference of 270° CA with respect to the preceding cylinder in the same bank.

According to the first embodiment of the invention, the V-type engine is an eight-cylinder engine having four cylinders in each bank, and the crank-angle phase differences between the cylinders of the engine are set at equal intervals of 90° CA, while the crank-angle differences between the cylinders in each bank are set at unequal intervals including 90° CA and 270° CA. Suppose the cylinders disposed in the left bank are sequentially designated as "#1 cylinder", "#3 cylinder", "#5 cylinder" and "#7 cylinder", and the cylinders disposed in the right bank are sequentially designated as "#2 cylinder", "#4 cylinder", "#6 cylinder" and "#8 cylinder", for the sake of easier understanding, these cylinders #1 through #8 operate in four-stroke cycles with a crank-angle phase shift of 90° CA, in the sequence, for example, #1→#8→#7→#3→#6→#5→#4→#2→#1. In this case, the crank-angle phase differences between the cylinders in the left bank are set such that the crank-angle phase of #1 cylinder is shifted by 180° CA from that of #7 cylinder, the phase of #7 cylinder is shifted by 90° CA from that of #3 cylinder, the phase of #3 cylinder is shifted by 180° CA from that of #5 cylinder, and the phase of #5 cylinder is shifted by 270° CA from that of #1 cylinder. On the other hand, the crank-angle phase differences between the cylinders in the right bank are set such that the crank-angle phase of #8 cylinder is shifted by 270° CA from that of #6 cylinder, the phase of #6 cylinder is shifted by 180° CA from that of #4 cylinder, the phase of #4 cylinder is shifted by 90° CA from that of #2 cylinder, and the phase of #2 cylinder is shifted by 180° CA from that of #8 cylinder. In order to reduce the size of the V-type eight-cylinder engine in the axial direction of the crankshaft, for example, the crank-angle phase differences between the cylinders in each bank are generally set at unequal intervals, as described above.

According to the first embodiment of the invention, the pump cam of each bank has two cam noses that are formed in the same shape at equal intervals over the entire circumference of the pump cam, and the pump cams of the two banks are arranged to drive the fuel pump or pumps in phase with each other. The phase of the pump cam relative to the valve cams is determined such that the phase in which the top of one of the cam noses of the pump cam acts on the fuel pump is advanced by an angle within the range of 120° CA to 180° CA from the phase in which the top of the cam nose of one of the valve cams for driving the corresponding engine valve of a specified cylinder of the engine acts on an actuator linked to the engine valve. The specified cylinder is located in the bank in which the pump cam is provided, and provides a crank-angle phase difference of 270° CA with respect to the preceding cylinder in the same bank. More specifically, the phase in which the top of one of the cam noses of the pump cam in the left bank acts on the fuel pump is advanced by an angle within the range of 120° CA to 180° CA from the phase in which the top of the cam nose of the valve cam that drives the engine valve of #1 cylinder in the left bank acts on an actuator linked to the engine valve. Alternatively, the phase in which the top of one of the cam noses of the pump cam in the right bank acts on the fuel pump is advanced by an angle within the range of 120° CA to 180° CA from the phase in which the top of the cam nose of the valve cam for driving the engine valve of #6 cylinder in the right bank acts on an actuator linked to the engine valve. In this embodiment in which the two cam noses of the pump cam are formed in the same shape at equal intervals, the top of the other cam nose is located on the 360° CA advance side as measured from the top of the above-indicated one cam nose. Also, the pump cams of the left and right banks are arranged to rotate in phase with each other.

If the phase of the pump cam relative to the valve cams is set in the manner as described above, the maximum value of a composite torque as the sum of the torque for driving the engine valves and the torque for driving the fuel pump can be reduced in the left bank and the right bank. Thus, the maximum value of the driving torque of the camshaft can be reduced, and fluctuations in the driving torque of the camshaft can be suppressed. The above-described manner of setting the phase of the pump cam relative to the valve cams on the camshaft may be applied to any type of camshaft formed with a pump cam, irrespective of whether the camshaft is an intake camshaft for driving intake valves or an exhaust camshaft for driving exhaust valves, to favorably suppress fluctuations in the driving torque of the camshaft.

In a second embodiment of the above aspect of the invention, the V-type engine has four cylinders in each of the two banks, and crank-angle phase differences between the cylinders of the engine are set at equal intervals of 90° CA, while crank-angle phase differences between the cylinders in each bank are set at unequal intervals including 90° CA and 270° CA. In this valve system, the pump cam of each bank has two cam noses that are formed in the same shape at equal intervals over the entire circumference of the pump cam, and the pump cams of the two banks are arranged to drive the corresponding fuel pump in opposite phase to each other. The phase of the pump cam relative to the valve cams is determined in terms of the crank angle such that the phase in which the top of one of the cam noses of the pump cam acts on the fuel pump is advanced by an angle within a range of 240° CA to 300° CA from the phase in which the top of a cam nose of one of the valve cams that drives the corresponding engine valve of a specified cylinder acts on an actuator linked to the engine valve. The specified cylinder is located in the bank in which the pump cam is provided, and provides a crank-angle phase difference of 270° CA with respect to the preceding cylinder in the same bank.

More specifically, the phase in which the top of one of the cam noses of the pump cam in the left bank acts on the fuel pump is advanced by an angle within the range of 240° CA to 300° CA from the phase in which the top of the cam nose of the valve cam for driving the engine valve of the #1 cylinder in the left bank acts on an actuator linked to the engine valve. Alternatively, the phase in which the top of one of the cam noses of the pump cam in the right bank acts on the fuel pump is advanced by an angle within the range of 240° CA to 300° CA from the phase in which the top of the cam nose of the valve cam for driving the engine valve of the #6 cylinder in the right bank acts on an actuator linked to the engine valve. In this embodiment in which the two cam noses of the pump cam are formed in the same shape at equal intervals, the top of the other cam nose is located on the 360° CA advance side as measured from the top of the above-indicated one cam nose. Also, the pump cams of the left and right banks are arranged to rotate with a phase difference of 180° CA.

If the phase of the pump cam relative to the valve cams is set in the manner as described above, the maximum value of a composite torque is the sum of the torque for driving the engine valves and the torque for driving the fuel pump can be reduced while being well-balanced between the left bank and the right bank. Thus, the maximum value of the driving torque applied to the camshaft can be reduced, and fluctuations in the driving torque of the camshaft can be suppressed. The above-described manner of setting the phase of the pump cam relative to the valve cams on the camshaft may be applied to any type of camshaft formed with a pump cam, irrespective of whether the camshaft is an intake camshaft that drives the intake valves or an exhaust camshaft that drives the exhaust valves, to favorably suppress fluctuations in the driving torque of the camshaft.

In the valve system of the V-type engine according to the above aspect of the invention, a fuel pump may be disposed in each of the banks, and may be driven by the camshaft of each bank. This arrangement allows the use of fuel pumps that have a small pump capacity even if a large quantity of fuel needs to be delivered from the fuel pumps.

The valve system of the V-type engine according to the above aspect of the invention may further include a variable valve timing mechanism that changes valve timing of the engine valves by changing the phase of the valve cams relative to the crankshaft of the engine. In this case, the phase of the pump cam relative to the crankshaft is changed synchronously with the change in the phase of the valve cams relative to the crankshaft.

In the valve system as described just above, when the phase of the valve cams relative to the crankshaft is changed by the variable valve timing mechanism, the phase of the pump cam relative to the camshaft is changed in synchronism with the change in the phase of the valve cams. Therefore, the relationship in phase or angular position between the valve cams and the pump cam can be maintained or kept unchanged when the valve timing is changed by the variable valve timing mechanism. Thus, even if the valve timing is changed, the maximum value of the driving torque of the camshaft can be reduced, and fluctuations in the driving torque of the camshaft can be suppressed.

BRIEF DESCRIPTION OF THE DRAWINGS

The foregoing and/or further objects, features and advantages of the invention will become more apparent from the following description of exemplary embodiments with reference to the accompanying drawings, in which like numerals are used to represent like elements and wherein.

DETAILED DESCRIPTION OF EXEMPLARY EMBODIMENTS

Referring to FIG. 1 through FIG. 6, a valve system of a V-type engine constructed according to a first embodiment of the invention will be described in detail.

Figure 1:
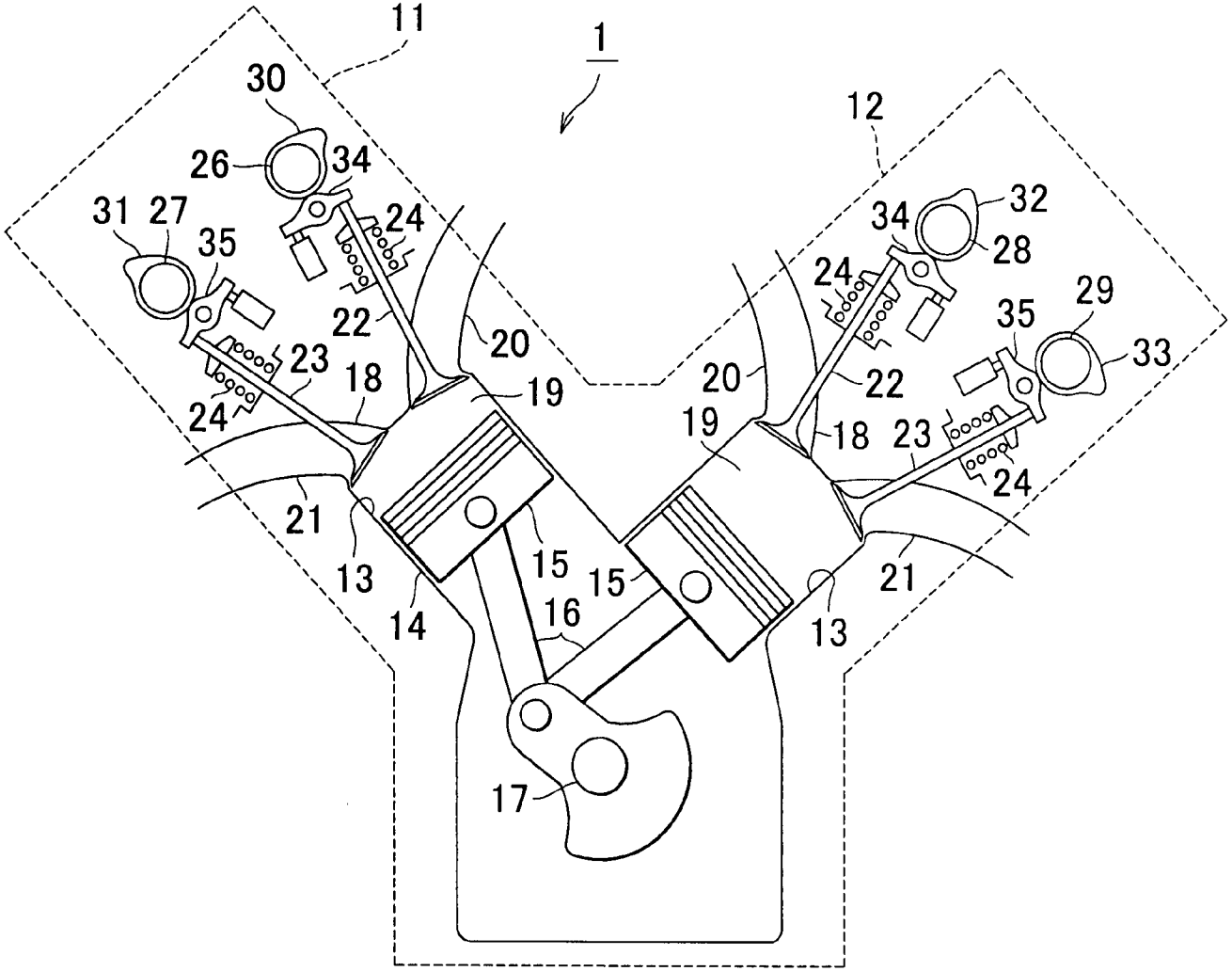
FIG. 1 is a schematic view of a V-type engine in which a valve system according to a first embodiment of the invention is installed.

FIG. 1 schematically shows a V-type engine 1 in which the valve system of according to the first embodiment is installed. The V-type engine 1 has a left bank 11 and a right bank 12 which are arranged in the shape of the letter V with an angular spacing of 90° between the banks. The V-type engine 1 is an eight-cylinder engine in which each of the left and right banks 11, 12 has four cylinders. The V-type engine 1 includes a cylinder block 14 that defines the respective cylinders 13, and a piston 15 is received in each of the cylinders 13 such that the piston 15 reciprocates in the corresponding cylinder 13. The piston 15 is connected via a connecting rod 16 to a crankshaft 17 provided in the lower part of the V-type engine 1. The reciprocating motion of the piston 15 is converted into the rotary motion of the crankshaft 17 by use of the connecting rod 16.

A cylinder head 18 is provided on top of the cylinder block 14 for each of the left bank 11 and the right bank 12. A combustion chamber 19 is formed in each cylinder 13 between the bottom face of the cylinder head 18 and the upper end face of the corresponding piston 15. A pair of intake ports 20 and a pair of exhaust ports 21 that communicate with each of the combustion chambers 19 are formed in the cylinder head 18. In operation, air is drawn from the outside of the V-type engine 1 into the combustion chamber 19 through the intake ports 20, and exhaust gas produced in the combustion chamber 19 is discharged to the outside of the V-type engine 1 through the exhaust ports 21.

Intake valves 22 and exhaust valves 23 for opening and closing the intake ports 20 and the exhaust ports 21, respectively, are provided in the cylinder head 18 such that the valves 22, 23 reciprocate in the cylinder head 18. Each of the intake valves 22 and exhaust valves 23 is urged by a valve spring 24 in such a direction as to close the corresponding intake or exhaust port 20, 21.

First intake camshaft 26 and first exhaust camshaft 27 for driving (i.e., opening and closing) the intake valves 22 and the exhaust valves 23, respectively, of the left bank 11 are rotatably supported in the upper part of the cylinder head 18 of the left bank 11. Also, second intake camshaft 28 and second exhaust camshaft 29 for driving (i.e., opening and closing) the intake valves 22 and the exhaust valves 23, respectively, of the right bank 12 are rotatably supported in the upper part of the cylinder head 18 of the right bank 12. The first intake camshaft 26 and the second intake camshaft 28 are located closer to the space interposed between the left bank 11 and the right bank 12.

The camshafts 26-29 are connected to the crankshaft 17 by a timing belt (not shown) such that the crankshaft 17 can drive the camshafts 26-29. With the camshafts 26-29 driven or rotated by the crankshaft 17, valve cams 30, 31, 32, 33 formed on the respective camshafts 26-29 push corresponding intake rocker arms 34 and exhaust rocker arms 35, thereby to drive (i.e., open) the intake valves 22 and exhaust valves 23 against the bias force of the valve springs 24. As the intake valves 22 and the exhaust valves 23 are driven to be opened and closed in this manner, the intake ports 20 and the exhaust ports 21 are brought into communication with and are shut off from the corresponding combustion chambers 19. In one cycle of operation (consisting of the intake stroke, compression stroke, combustion stroke and the exhaust stroke) of the V-type engine 1, the crankshaft 17 makes two revolutions (i.e., rotates by 720° CA), and each camshaft 26-29 makes one revolution.

Figure 2:
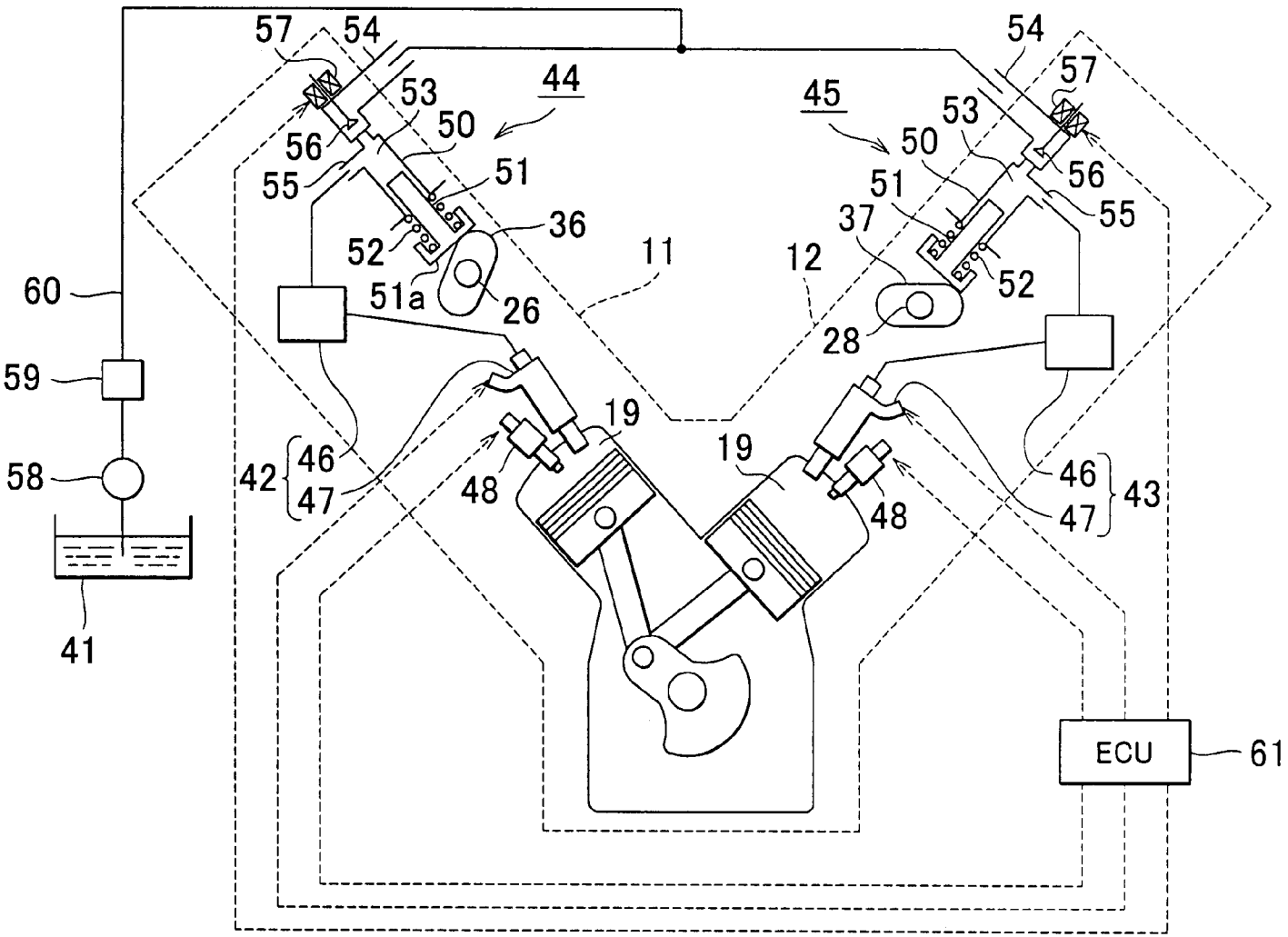
FIG. 2 is a schematic view showing a fuel supply system of the V-type engine of FIG. 1.

Next, a fuel supply system for supplying fuel to the combustion chambers 19 by utilizing rotation of the camshafts will be described. FIG. 2 schematically shows the fuel supply system of the V-type engine 1. The fuel supply system includes a fuel tank 41 in which the fuel is stored, fuel injection devices 42, 43 of the respective banks 11, 12 for supplying the fuel through injection, and fuel pumps 44, 45 that pressurize and feed the fuel to the fuel injection devices 42, 43 of the banks 11, 12, respectively.

Each of the fuel injection devices 42, 43 consists of a delivery pipe 46 and fuel injectors 47 provided in the cylinder head 18. The delivery pipe 46 is adapted to supply high-pressure fuel received from the fuel pump 44, 45 to the fuel injectors 47. When each of the fuel injectors 47 is energized, its fuel injection valve is opened so that the high-pressure fuel is injected into the corresponding combustion chamber 19. The fuel injected from the fuel injector 47 is mixed with air inducted into the combustion chamber 19, to thus form an air-fuel mixture in the chamber 19. The cylinder head 18 is also provided with ignition plugs or spark plugs 48 for igniting the air-fuel mixture in the respective combustion chambers 19.

The fuel pump 44 provided in the left bank 11 feeds the pressurized fuel to the fuel injection device 42 of the left bank 11 and the fuel pump 45 provided in the right bank 12 feds the pressurized fuel to the fuel injection device 43 of the right bank 12. The fuel pump 44 and the fuel pump 45, having the same construction, are driven by the first intake camshaft 26 and the second intake camshaft 28, respectively, as the camshafts 26, 28 rotate. Each of the fuel pumps 44, 45 has a cylinder 50, and a plunger 51 that is received in the cylinder 50 such that the plunger 51 can reciprocate in the cylinder 50. The first intake camshaft 26 is formed with a pump cam 36 that is in contact with the lower end portion 51*a* of the plunger 51 of the fuel pump 44, and the second intake camshaft 28 is formed with a pump cam 37 that is in contact with the lower end portion 51*a* of the plunger 51 of the fuel pump 45. The plunger 51 is urged by a spring 52 toward the corresponding pump cam 36, 37 so that the pump cam 36, 37 is constantly held in contact with the plunger 51.

Each of the fuel pumps 44, 45 has a pressure chamber 53 that is defined by the inner walls of the cylinder 50 and the upper end face of the plunger 51. As the pump cam 36, 37 rotates, the plunger 51 of the associated fuel pump 44, 45 repeatedly goes through an intake stroke in which the plunger 51 moves in such a direction as to increase the volume of the pressure chamber 53, and a pressure-feed stroke in which the plunger 51 moves in such a direction as to reduce the volume of the pressure chamber 53. When the plunger 51 is on the intake stroke, the fuel in the fuel tank 41 is drawn into the pressure chamber 53 via an intake port 54. When the plunger 51 is on the pressure-feed stroke, the fuel in the pressure chamber 53 is pressurized and delivered through a delivery port 55. Each of the pump cams 36, 37 has the shape of an ellipse, and two cam noses having the same shape are formed at equal intervals over the entire circumference of the pump cam. With this arrangement, the fuel pump 44, 45 pumps (feeding under pressure) the fuel twice at equal time intervals while the crankshaft 17 is making two revolutions or rotating by 720° CA. In order to suppress pulsation of the fuel, the pump cams 36, 37 rotate in phase with each other to drive the fuel pumps 44, 45 in phase with each other.

Each of the fuel pumps 44, 45 has an electromagnetic spill valve 56 that opens and closes to allow and inhibit fluid communication between the intake port 54 and the pressure chamber 53, and an electromagnetic solenoid 57 for driving the spill valve 56. In operation, voltage applied to the electromagnetic solenoid 57 is controlled to drive the electromagnetic spill valve 56 in a controlled manner. During the above-mentioned intake stroke, the electromagnetic spill valve 56 is opened to allow the fuel to flow from the intake port 54 into the pressure chamber 53. During the pressure-feed stroke, the electromagnetic spill valve 56 is closed for a specified period of time. When the plunger 51 is on the pressure-feed stroke, the fuel in the pressure chamber 53 overflows into the intake port 54 while the electromagnetic spill valve 56 is being opened, and the fuel in the pressure chamber 53 is fed under pressure into the delivery port 55 while the spill valve 56 is being closed. Thus, the period of time for which the electromagnetic spill valve 56 is closed during the pressure-feed stroke is controlled to adjust the quantity of the fuel that overflows into the intake port 54 and thereby adjust the quantity of the fuel delivered from the fuel pump 44, 45.

In the following, the operation of the fuel supply system of the V-type engine 1 will be described. Initially, the fuel stored in the fuel tank 41 is drawn up by a feed pump 58, and is fed through a supply channel 60, provided with a filter 59, to be distributed to the fuel pump 44, 45 provided for each bank. The fuel fed to the fuel pumps 44, 45 is pressurized in the pressure chambers 53 by the pump cams 36, 37, and is delivered from the fuel pumps 44, 45 with the quantity of delivery controlled by the electromagnetic spill valves 56, so that the fuel is fed under pressure to the fuel injection devices 42, 43 of the respective banks. The fuel is then supplied (injected) from the fuel injectors 47 of the fuel injection devices 42, 43 into the corresponding combustion chambers 19.

An ECU (Electronic Control Unit) 61 performs various controls of the fuel supply system of the V-type engine 1. More specifically, the ECU 61 controls the fuel injectors 47, electromagnetic spill valves 56 and the ignition plugs 48, based on detection signals received from various sensors (not shown) to detect engine operating conditions and to supply each combustion chamber 19 with fuel. The quantity of fuel that is supplied depends upon the engine operating conditions, and also control the combustion timing.

Figure 3:
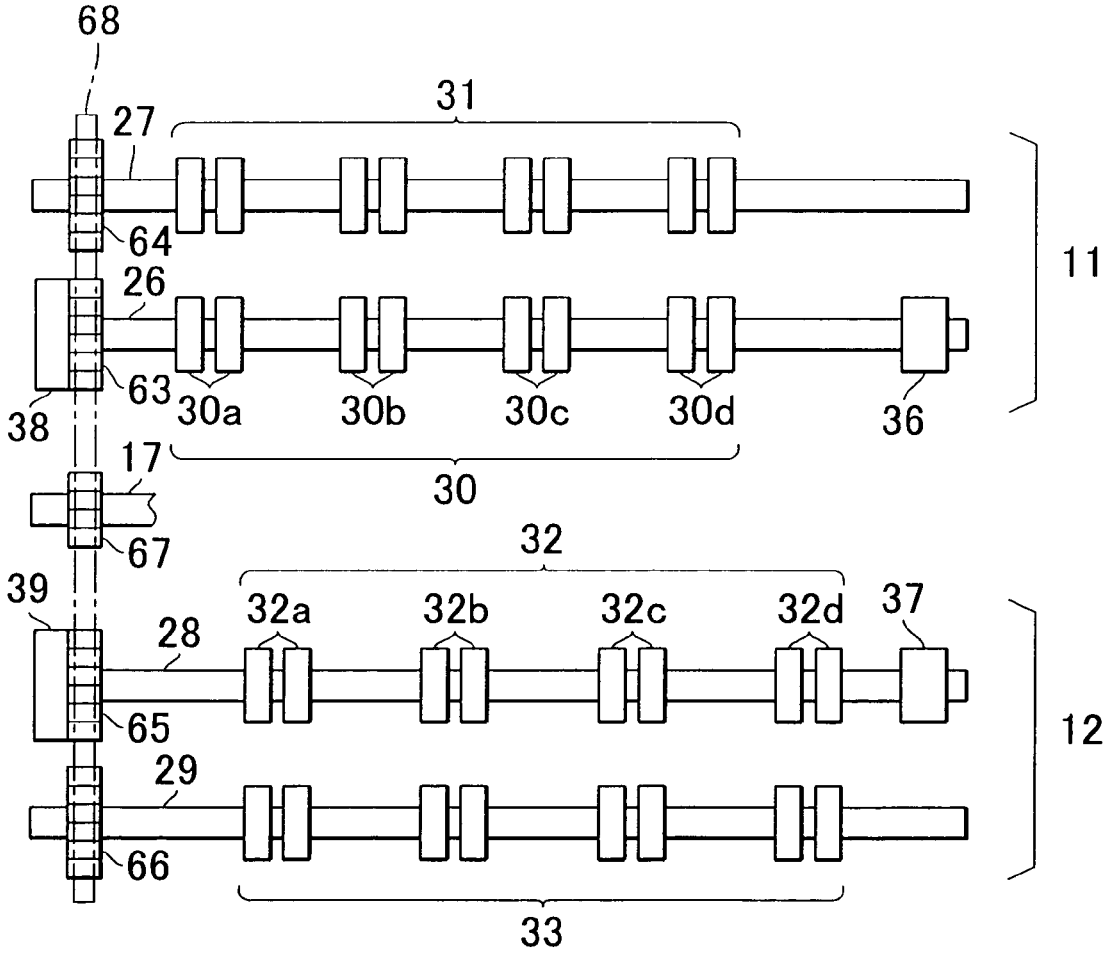
FIG. 3 is a view showing intake and exhaust camshafts of the valve system of FIG. 1.

Next, the construction of each camshaft 26-29 will be described. FIG. 3 illustrates the camshafts 26-29 as viewed from the top of the V-type engine 1. As shown in FIG. 3, the first intake camshaft 26 and the first exhaust camshaft 27 are arranged in parallel with each other in the left bank 11, and the second intake camshaft 28 and the second exhaust camshaft 29 are arranged in parallel with each other in the right bank 12. A pulley 63, 64, 65, 66 is fixed to one end of each of the camshafts 26-29 such that the pulley 63, 64, 65, 66 rotates as a unit with the corresponding camshaft 26, 27, 28, 29. As the crankshaft 17 rotates, rotation of a pulley 67 fixed to the crankshaft 17 is transmitted to the pulleys 63, 64, 65, 66 via the timing belt 68.

Valve cams 30-33 that drive the intake valves 22 and exhaust valves 23 are formed at equal intervals on the camshafts 26-29, respectively. In this specification, the cylinders of the left bank 11 will be sequentially called "#1 cylinder", "#3 cylinder", "#5 cylinder" and "#7 cylinder" in the direction from the ends of the camshafts 26-29 to which the pulleys 63-66 are fixed (i.e., from the left to the right in FIG. 3), and the cylinders of the right bank 12 will be sequentially called "#2 cylinder", "#4 cylinder", "#6 cylinder" and "#8 cylinder" in the same direction. The first intake camshaft 26 is provided with four pairs of valve cams 30*a*,

30*b*, 30*c*, 30*d*, each pair of which drives a pair of intake valves 22 of the corresponding one of #1, #3, #5 and #7 cylinders. The second intake camshaft 28 is provided with four pairs of valve cams 32*a*, 32*b*, 32*c*, 32*d*, each pair of which drives a pair of intake valves 22 of the corresponding one of #2, #4, #6 and #8 cylinders. Pump cams 36, 37 are formed on the first intake camshaft 26 and the second intake camshaft 28, respectively, to be located on the sides (right-hand sides in FIG. 3) opposite to the pulleys 63, 65.

The first intake camshaft 26 and the second intake camshaft 28 are provided at their end portions having the pulleys 63, 65 with variable valve timing mechanisms (which will be called "VVT mechanisms") 38, 39, respectively. The VVT mechanisms 38, 39 adjust the respective rotational phases of the first intake camshaft 26 and second intake camshaft 28 relative to the rotational phase of the crankshaft 17, to make the valve timing variable. More specifically, the VVT mechanisms 38, 39 operate to advance or retard the timing of the opening and closing of the intake valves 22 while keeping the valve opening period (or operating angle) of the intake valves 22 constant. To drive the VVT mechanisms 38, 39, suitably controlled hydraulic pressures are applied to the VVT mechanisms 38, 39 through hydraulic actuators (not shown). In the meantime, the valve cams 30, 32 and the pump cams 36, 37 rotate as a unit with the first intake camshaft 26 and the second intake camshaft 28, respectively. Therefore, even if the valve timing is changed by the VVT mechanisms 38, 39, the phase of the valve cams 30, 32 relative to the pump cams 36, 37 (i.e., the relationship in the angular position between the valve cams 30, 32 and the pump cams 36, 37) is maintained, namely, is kept from being changed with the valve timing. In other words, the phase of the pump cam 36, 37 on the first or second intake camshaft 26, 28 is changed synchronously with a change in the phase of the valve cams 30, 32 upon a change of the valve timing.

Next, the valve opening and closing timing of the V-type engine 1 will be explained. In the V-type engine 1, crank-angle phase differences (i.e., phase differences as measured in the crank angle) among the eight cylinders are set at equal intervals of 90° CA, and the phase of the piston as expressed by the crank angle (which will be called "crank-angle phase") is shifted in the sequence #1 cylinder, #8 cylinder, #7 cylinder, #3 cylinder, #6 cylinder, #5 cylinder, #4 cylinder and #2 cylinder. For example, if the combustion stroke starts at 0° CA in #1 cylinder, the combustion stroke starts at 90° CA in #8 cylinder and starts at 180° CA in #7 cylinder, and so forth. With regard to the cylinders in the left bank 11, in particular, the crank-angle phase differences are set such that the crank-angle phase of #1 cylinder is shifted by 180° CA from that of #7 cylinder, the crank-angle phase of #7 cylinder is shifted by 90° CA from that of #3 cylinder, the crank-angle phase of #3 cylinder is shifted by 180° CA from that of #5 cylinder, and the crank-angle phase of #5 cylinder is shifted by 270° CA from that of #1 cylinder. With regard to the cylinders in the right bank 12, on the other hand, the crank-angle phase differences are set such that the crank-angle phase of #8 cylinder is shifted by 270° CA from that of #6 cylinder, the crank-angle phase of #6 cylinder is shifted by 180° CA from that of #4 cylinder, the crank-angle phase of #4 cylinder is shifted by 90° CA from that of #2 cylinder, and the crank-angle phase of #2 cylinder is shifted by 180° CA from that of #8 cylinder. Thus, the crank-angle phase differences among the cylinders in each of the banks 11, 12 are set at unequal intervals including 90° CA and 270° CA. The opening and closing times of the intake valves 22 and exhaust valves 23 provided in the respective cylinders are set to provide the crank-angle phase differences as indicated above.

Figure 4B:
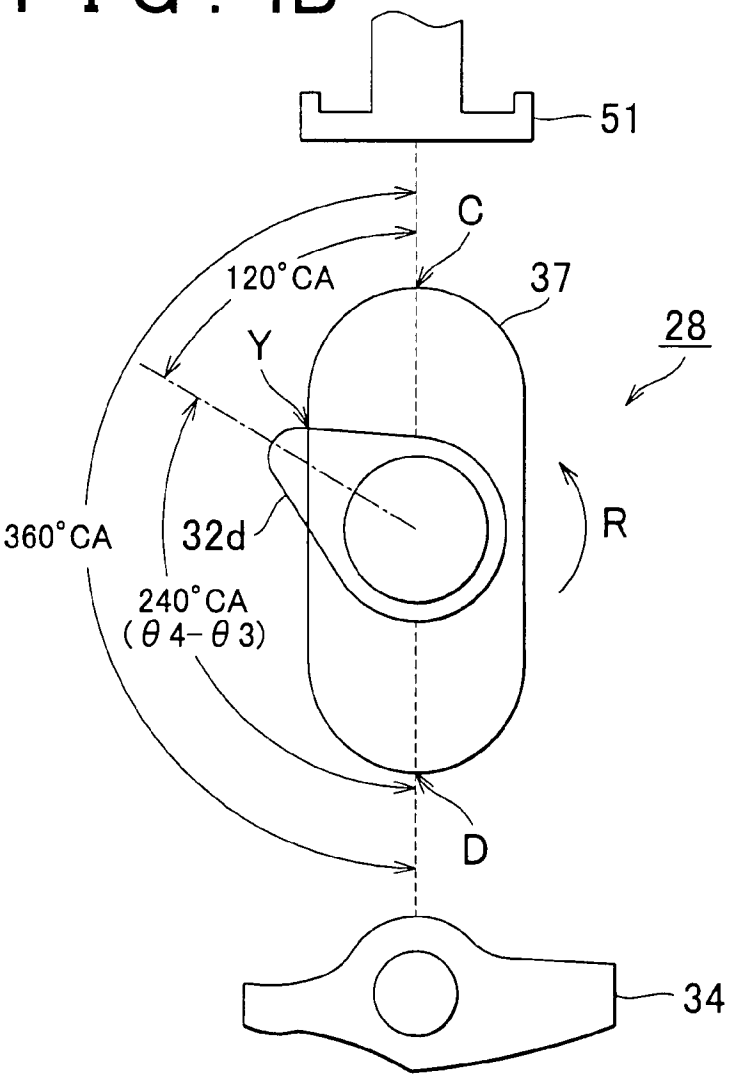
FIG. 4B is an explanatory view showing the phase of a pump cam relative to a valve cam on an intake camshaft of the right bank in the first embodiment.
Figure 4A:
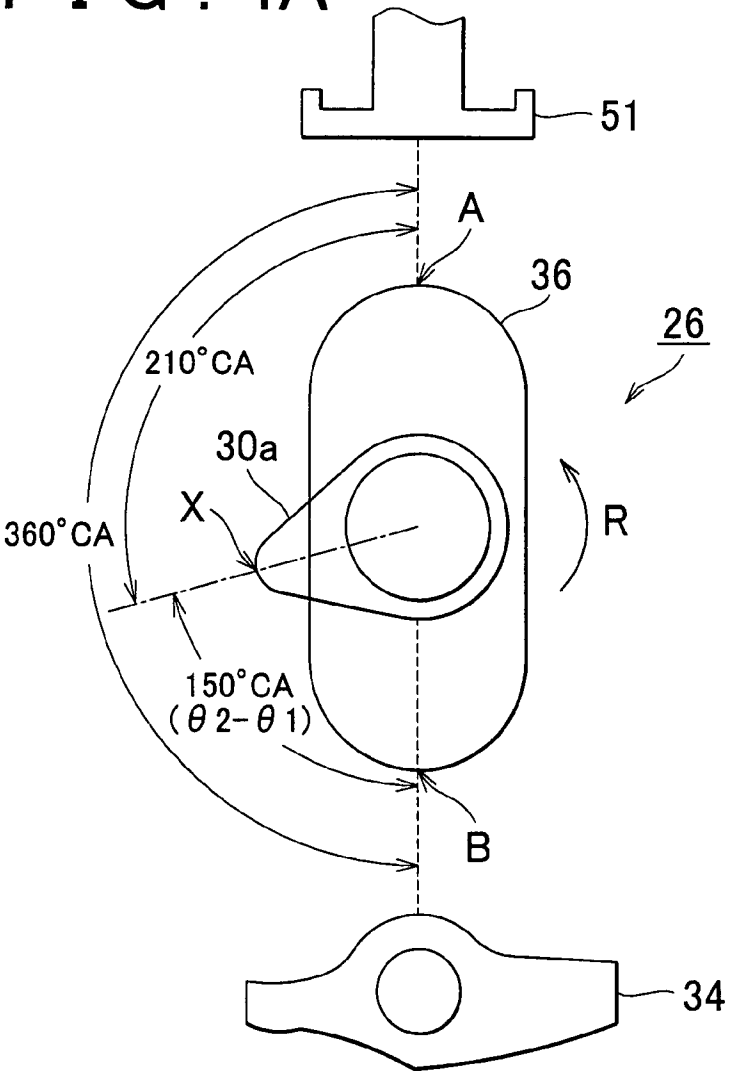
FIG. 4A is an explanatory view showing the phase of a pump cam relative to a valve cam on the intake camshaft of the left bank in the first embodiment.

Next, the pump cams 36, 37 for driving the fuel pumps 44, 45 will be explained. While the phase (or angular position) of each pair of the valve cams 30, 32 on the intake camshafts 26, 28 is set depending upon the timing of the opening and closing of the associated intake valves, the phase of each pump cam 36, 37 may be set as desired. As explained below, the phase of the pump cam 36, 37 is set to suppress or reduce fluctuations in the torque applied to each of the intake camshafts 26, 28. FIG. 4A and FIG. 4B show the configurations of the pump cams 36, 37 on the intake camshafts 26, 28, respectively. In FIGS. 4A and 4B, the intake camshafts 26, 28 rotate in the direction of arrow R. FIG. 4A illustrates a condition in which the top A of one of the cam noses of the pump cam 36 acts on the plunger 51, while FIG. 4B illustrates a condition in which the top C of one of the cam noses of the pump cam 37 acts on the plunger 51.

FIG. 4A shows the phase of the pump cam 36 that drives the fuel pump 44 of the left bank 11, relative to the plunger 51 of the fuel pump 44, one of the valve cams 30*a* and the corresponding intake rocker arm 34. The pump cam 36 is formed on the first intake camshaft 26 such that the phase θ1 in which the top A of one of the cam noses of the pump cam 36 acts on the plunger 51 is advanced by 150° CA from the phase θ2 in which the top X of the cam nose of the valve cam 30*a* acts on the intake rocker cam 34 of #1 cylinder. Namely, the phase difference (θ2−θ1) is equal to 150° CA. With this arrangement, the top X of the valve cam 30*a* acts on the intake rocker arm 34 when the first intake camshaft 26 rotates 150° CA after the top A of the pump cam 36 acts on the plunger 51. Because the plunger 51 and the intake rocker arm 34 are positioned relative to each other to provide a difference of 360° CA between the point of action of the pump cam 36 and the point of action of the valve cam 30*a* in the direction of rotation of the intake camshaft 26, a phase difference between the top A of the pump cam 36 and the top X of the valve cam 30*a* is equal to 210° CA, as shown in FIG. 4A. The top B of the other cam nose of the pump cam 36 is formed on the side opposite to the top A such that the top B is advanced 360° CA from the top A.

FIG. 4B shows the phase of the pump cam 37 that drives the fuel pump 45 of the right bank 12, relative to the plunger 51 of the fuel pump 45, one of the valve cams 32*d* and the corresponding intake rocker arm 34. Because the pump cam 37 rotates in phase with the pump cam 36, the top C of one of the cam noses of the pump cam 37 acts on the plunger 51 when the top A of the pump cam 36 acts on the plunger 51. The pump cam 37 is formed on the second intake camshaft 28 such that the phase θ3 in which the top C of one of the cam noses of the pump cam 37 acts on the plunger 51 is advanced by 240° CA from the phase θ3 in which the top Y of the cam nose of the valve cam 32*d* acts on the intake rocker cam 34 of #8 cylinder. Namely, the phase difference (θ4−θ3) is equal to 240° CA. With this arrangement, the top Y of the valve cam 32*d* acts on the intake rocker arm 34 when the second intake camshaft 28 rotates 240° CA after the top C of the pump cam 37 acts on the plunger 51. Because the plunger 51 and the intake rocker arm 34 are positioned relative to each other to provide a difference of 360° CA between the point of action of the pump cam 37 and the point of action of the valve cam 32*d* in the direction of rotation of the intake camshaft 28, a phase difference between the top C of the pump cam 37 and the top Y of the valve cam 32*d* is equal to 120° CA, as shown in FIG. 4B. The top D of the other cam nose of the pump cam 37 is formed on the side opposite to the top C such that the top D is advanced 360° CA from the top C.

Figure 5A:
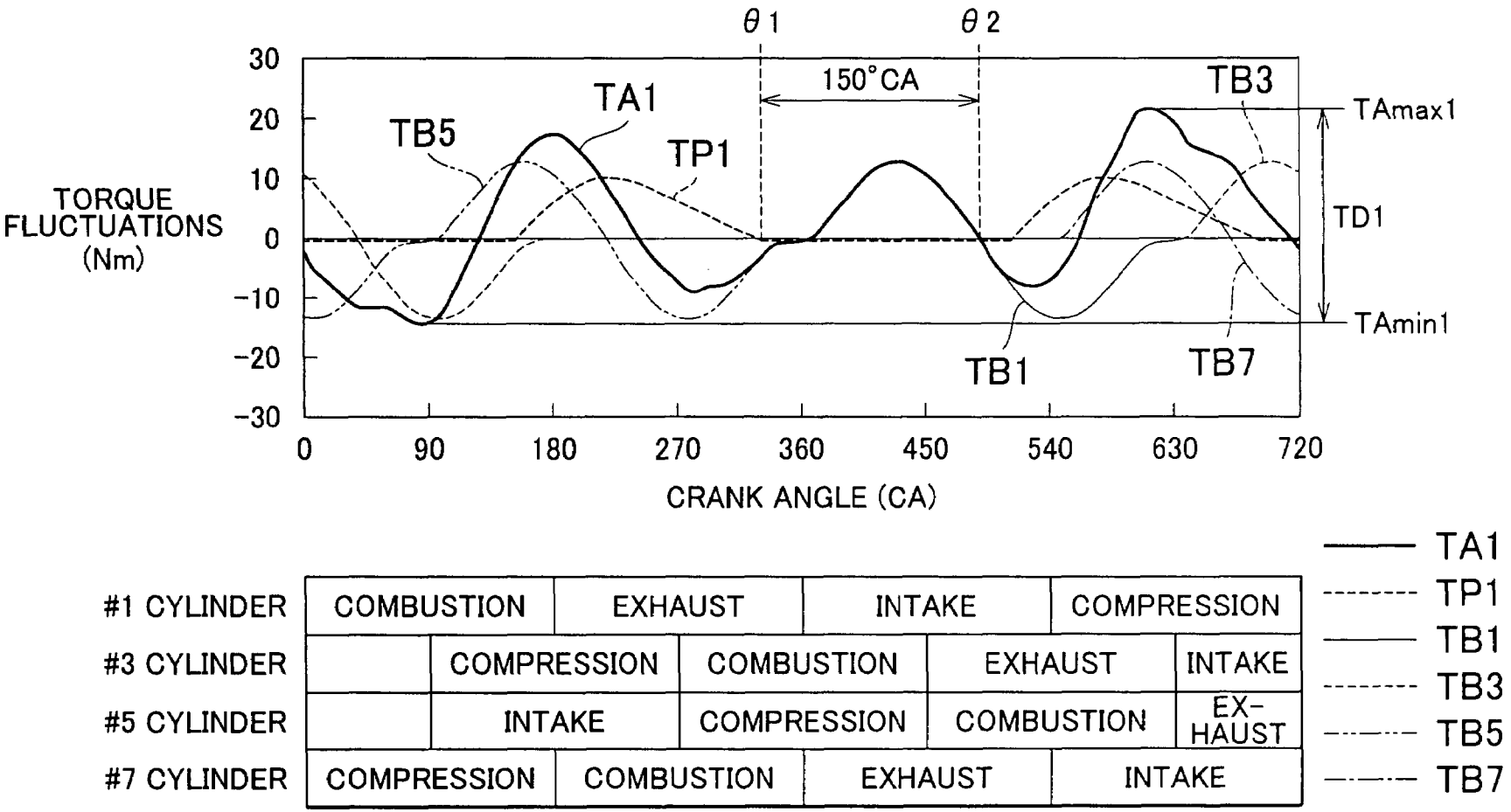
FIG. 5A is a graph indicating torque fluctuations of the intake camshaft of the left bank.
Figure 5B:
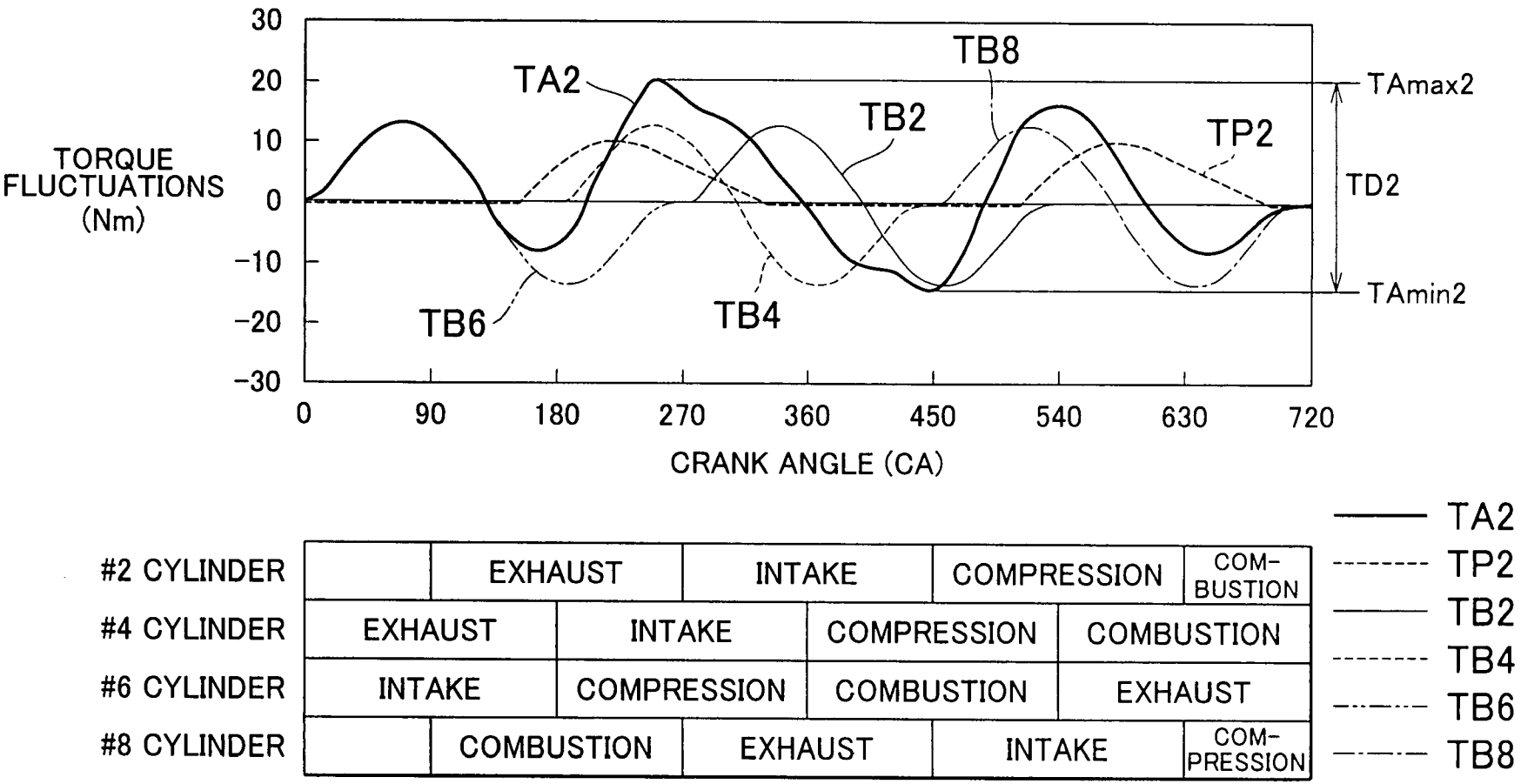
FIG. 5B is a graph indicating torque fluctuations of the intake camshaft of the right bank.

Next, fluctuations in the torque applied to the first intake camshaft 26 and second intake camshaft 28 will be described. FIG. 5A and FIG. 5B are graphs indicating torque fluctuations (Nm) arising in the first intake camshaft 26 and the second intake camshaft 28, respectively, with respect to the crank angle (CA). In FIGS. 5A and 5B, the crank angle is equal to 0° CA when the piston of #1 cylinder is at the top dead center at which the combustion stroke starts.

FIG. 5A indicates torque fluctuations of the first intake camshaft 26. The first intake camshaft 26 is subjected to torque fluctuations in driving the intake valves 22 of the respective cylinders in the left bank 11 and torque fluctuations in driving the fuel pump 44. The lower part of FIG. 5A indicates the strokes of each of the cylinders of the left bank 11.

In FIG. 5A, TB1, TB3, TB5 and TB7 represent torque fluctuations in driving the intake valves 22 of #1 cylinder, #3 cylinder, #5 cylinder and #7 cylinder, respectively. The following explanation is concerned with torque fluctuations in driving the intake valves 22, taking driving torque variations TB1 of the #1 cylinder as an example. The intake valves 22 of the #1 cylinder are open at 360° CA at which the intake stroke starts, and are closed at 600° CA in the initial period of the compression stroke. Because each valve cam 30*a* of the first intake camshaft 26 drives (i.e., opens and closes) the corresponding intake valve 22 of #1 cylinder against the valve spring 24, the driving torque varies on the positive side (i.e., increases by varying degrees) in the period between 360° CA at which the valve 22 opens and 480° CA at which the top X of the valve cam 30*a* acts on the intake rocker arm 34, and the driving torque varies on the negative side (i.e., decreases by varying degrees) in the period between 480° CA and 600° CA at which the valve 22 closes. The driving torque fluctuations, which are related with the cam profile of the valve cams 30, assume the shape of a generally sinusoidal wave. The driving torque fluctuation becomes equal to zero at the time of closing of the intake valves 22. Likewise, driving torque fluctuations similar to those of the #1 cylinder take place in the #3 cylinder, #5 cylinder and #7 cylinder in timing shifted by different crank angles from that of #1 cylinder, as shown in FIG. 5A.

In FIG. 5A, TP1 represents torque fluctuations in driving the fuel pump 44. The above-mentioned phase θ2 in which the top X of the cam nose of the valve cam 30*a* of #1 cylinder acts on the intake rocker arm 34 is 480° CA in the example of FIG. 5A, and, therefore, the phase θ1 in which the top A of one of the cam noses of the pump cam 36 acts on the plunger 51 is 330° CA, which is advanced 150° CA from the phase θ2. Thus, the cam noses of the pump cam 36 start acting on the plunger 51 at 150° CA and 510° CA, and the tops of the cam noses act on the plunger 51 at 330° CA and 690° CA. Namely, the periods corresponding to the pressure-feed stroke of the fuel pump 44 for feeding the fuel under pressure for delivery are between 150° CA and 330° CA and between 510° CA and 690° CA, and the remaining periods correspond to the intake stroke of the fuel pump 44 in which the fuel is drawn into the fuel pump 44. The driving torque for the fuel pump 44 varies on the positive side (i.e., increases by varying degrees) in the period of 150° CA to 330° CA and the period of 510° CA to 690° CA, and the torque fluctuation TP1 is substantially equal to zero in the remaining periods. In the example of FIG. 5A, the maximum value of the driving torque fluctuations TP1 is about 60% of the maximum values of the driving torque fluctuations TB1, TB3, TB5 and TB7.

In FIG. 5A, TA1 represents a composite of the driving torque fluctuations TB1, TB3, TB5, TB7 associated with the intake valves 22 and the driving torque fluctuations TP1 associated with the fuel pump 44. Through two revolutions (720° CA rotation) of the crankshaft, the torque fluctuations TA1 take place in the first intake camshaft 26 while the cylinders in the left bank 11 go through the four strokes in the manner as indicated in FIG. 5A. The maximum torque TAmax1 of the torque fluctuations TA1 appears at 600° CA, and the minimum torque TAmin1 appears at 90° CA. It will be understood from FIG. 5A that the phase of the pump cam 36 relative to the valve cams 30 is set such that the crank angles at which the driving torque for the fuel pump 44 is maximized in the waveform of the driving toque fluctuations TP1 do not coincide with the crank angles at which the driving torques for the intake valves 22 are maximized in the waveforms of the driving torque fluctuations TB1, TB3, TB5, TB7. This arrangement reduces the maximum torque TAmax1 in the torque fluctuations TA1, and thereby reduces the amplitude TD1 of the torque fluctuations TA1, which is the difference between the maximum torque TAmax1 and the minimum torque TAmin1.

FIG. 5B shows fluctuations in the torque applied to the second intake camshaft 28. The second intake camshaft 28 is subjected to torque fluctuations in driving the intake valves 22 of the respective cylinders in the right bank 12 and torque fluctuations in driving the fuel pump 45. The lower part of FIG. 5B indicates the strokes of each of the cylinders of the right bank 12.

In FIG. 5B, TB2, B4, B6 and TB8 represent torque fluctuations in driving the intake valves 22 during the intake strokes of the #2 cylinder, #4 cylinder, #6 cylinder and #8 cylinder, respectively. The driving torque fluctuations TB2, TB4, TB6 and TB8 appear in similar forms to the driving torque variations TB1 of #1 cylinder as described above. In FIG. 5B, TP2 represents torque fluctuations in driving the fuel pump 45. Because the pump cam 37 rotates in phase with the pump cam 36, the driving torque fluctuations TP2 appear in substantially the same phase and form as the driving torque fluctuations TP1 of FIG. 5A.

In FIG. 5B, TA2 represents a composite of the driving torque fluctuations TB2, TB4, TB6 and TB8 associated with the intake valves 22 and the driving torque fluctuations TP2 associated with the fuel pump 45. Through two revolutions (720° CA rotation) of the crankshaft, the torque fluctuations TA2 take place in the second intake camshaft 28 while the cylinders in the right bank 12 go through the four strokes in the manner as indicated in FIG. 5B. The maximum torque TAmax2 of the torque fluctuations TA2 appears at 240° CA, and the minimum torque TAmin2 appears at 450° CA. It will be understood from FIG. 5B that the phase of the pump cam 37 relative to the valve cams 32 is set such that the crank angles at which the driving torque for the fuel pump 45 is maximized in the waveform of the driving toque fluctuations TP2 do not coincide with the crank angles at which the driving torques for the intake valves 22 are maximized in the waveforms of the driving torque fluctuations TB2, TB4, TB6, TB8. This arrangement makes it possible to reduce the maximum torque TAmax2 in the torque fluctuations TA2, and thereby reduce the amplitude TD2 of the torque fluctuations TA2, which is a difference between the maximum torque TAmax2 and the minimum torque TAmin2.

Figure 6:
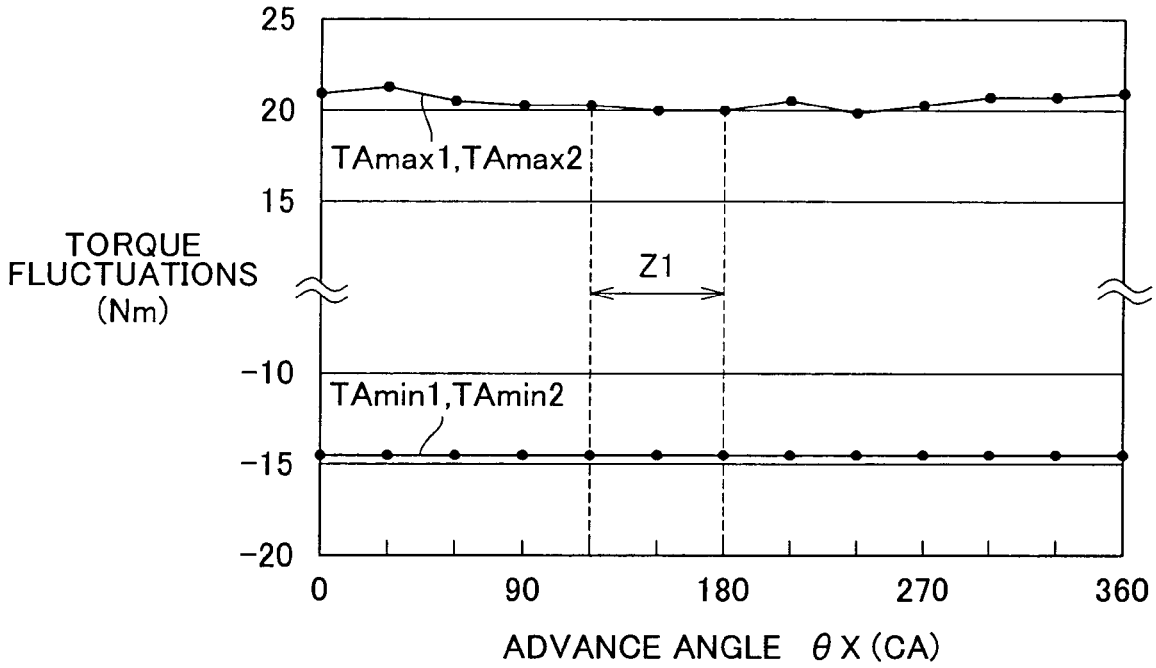
FIG. 6 is a graph indicating changes in the maximum torque and the minimum torque with respect to the angle of advance.

The following explanation is concerned with torque fluctuations applied to the first intake camshaft 26 and second intake camshaft 28 when the phase of the pump cam 36, 37 relative to the valve cams 30, 32 is changed in the valve system of the V-type engine 1 as described above. In the illustrated embodiment, the pump cam 36 and valve cams 30 are formed on the first intake camshaft 26 such that the above-mentioned phase θ1 is advanced 150° CA from the phase θ2. The graph of FIG. 6 shows changes in the maximum torque TAmax1, TAmax2 and the minimum torque TAmin1, TAmin2, which changes are observed when the phase θ1 is changed relative to the phase θ2. In FIG. 6, the horizontal axis indicates angle θx of advance of the phase θ1 relative to the phase θ2. As is understood from FIG. 5A and FIG. 5B, the torque fluctuations TA1 of the first intake camshaft 26 are phase-shifted by 360° CA from the torque fluctuations TA2 of the second intake camshaft 28, and, therefore, the maximum torque TAmax1 is equal to the maximum torque TAmax2 while the minimum torque TAmin1 is equal to the minimum torque TAmin2. Also, the phase of the pump cam 36, 37 changes in the cycle of 360° CA, and, therefore, FIG. 6 shows changes in the maximum and minimum torques observed when the advance angle θx varies within a range of 0° CA to 360° CA.

As shown in FIG. 6, when the advance angle θx is in a range Z1 of 120° CA to 180° CA, the maximum torque value TAmax1, TAmax2 is small. On the other hand, there is almost no change in the minimum torque TAmin1, TAmin2 with respect to the advance angle θx. Thus, when the phase θ1 is advanced by 120° CA to 180° CA from the phase θ2, the maximum torque TAmax1, TAmax2 applied to each of the intake camshafts 26, 28 can be reduced, and the amplitude TD1, TD2 of the torque fluctuations TA1, TA2 can be reduced. Although the maximum torque TAmax1, TAmax2 changes depending upon the magnitude of the driving torque fluctuations TP1, TP2 or the magnitude of the driving torque fluctuations TB1-TB8, the maximum torque changes (i.e., increases or decreases) with respect to the advance angle θx in substantially the same manner or fashion except when the magnitude of the driving torque fluctuations TP1, TP2 is significantly larger or smaller than those of the driving torque fluctuations TB1-TB8.

It will be understood from the above description that in the first embodiment in which the phase θ1 is set to be advanced by 150° CA from the phase θ2, the maximum torque and torque fluctuations applied to the first intake camshaft 26 and second intake camshaft 28 are advantageously reduced.

The valve system of the V-type engine according to the first embodiment of the invention provides the following advantageous effects.

(1) In the first embodiment, the valve system of the V-type engine 1 is constructed such that the crank angles at which the driving torque of the pump cam 36, 37 having two cam noses is maximized do not coincide with the crank angles at which the driving torque of the valve cams 30, 32 is maximized. Therefore, if crank-angle phase differences among the cylinders in each of the banks 11, 12 are set at unequal intervals, and torque fluctuations in driving the intake valves 22 take a complicated or irregular form, the maximum torque TAmax1, TAmax2 in the torque fluctuations TA1, TA2 of each of the intake camshafts 26, 28 can be reduced, and the amplitude (i.e., difference between the maximum torque and the minimum torque) TD1, TD2 of the torque fluctuations TA1, TA2 can also be reduced. Thus, reducing the maximum tension applied to the timing belt 68 that drives the intake camshafts 26, 28 and also reducing the amplitude of fluctuations in the tension, thereby to prevent otherwise possible reduction of the service life of the timing belt 68.

(2) In the first embodiment, the pump cams 36, 37 rotate in phase with each other, and the phase θ1 in which the top A of one of the cam noses of the pump cam 36 acts on the plunger 51 is advanced 150° CA from the phase θ2 in which the top X of the cam nose of each valve cam 30*a* of #1 cylinder acts on the intake rocker arm 34. In each of the banks 11, 12, therefore, the maximum torque TAmax1, TAmax2 in the torque fluctuations TA1, TA2 of each of the intake camshafts 26, 28 is reduced, and the amplitude TD1, TD2 of the torque fluctuations TA1, TA2 is also reduced.

(3) In the first embodiment, two cam noses having the same shape or profile are formed at equal intervals over the entire circumference of each of the pump cams 36, 37, and the fuel pump 44, 45 is driven twice at equal time intervals while the crankshaft 17 makes two revolutions (i.e., rotates by 720° CA). This arrangement reduces the driving torque required each time to drive the fuel pump 44, 45, as compared with the case where the fuel pump 44, 45 is driven only once while the crankshaft 17 makes two revolutions. Consequently, the torque fluctuations TA1, TA2 applied to each of the intake camshafts 26, 28 are suppressed or reduced.

(4) In the first embodiment, the fuel pump 44, 45 is provided for each bank 11, 12, and is driven by the corresponding one of the first and second intake camshafts 26, 28 of the banks 11, 12. This arrangement allows the use of fuel pumps having a small pump capacity, even in an eight-cylinder engine that requires a relatively large amount of fuel to be delivered from the fuel pumps 44, 45.

(5) In the first embodiment, the valve cams 30, 32 and the pump cams 36, 37 rotate as a unit with the first intake camshaft 26 and the second intake camshaft 28, respectively. Therefore, even if the valve timing is changed by the variable valve timing mechanisms 38, 39, the relationships in the angular position or phase between the valve cams 30, 32 and the pump cams 36, 37 are maintained or kept from being changed with the valve timing. Thus, even with a change in the valve timing, the maximum torque TAmax1, TAmax2 in the torque fluctuations TA1, TA2 of each of the intake camshafts 26, 28 is reduced, and the amplitude TD1, TD2 of the torque fluctuations TA 1, TA2 is also reduced.

Referring next to FIG. 7 through FIG. 9, a valve system of a V-type engine according to a second embodiment of the invention will be described. The second embodiment differs from the first embodiment only in the phases or angular positions of the pump cams formed on the first intake camshaft 26 and the second intake camshaft 28. In the following description, the same reference numerals as used in the first embodiment will be used for identifying the same or corresponding elements or components, of which explanation will not be repeated.

Figure 7B:
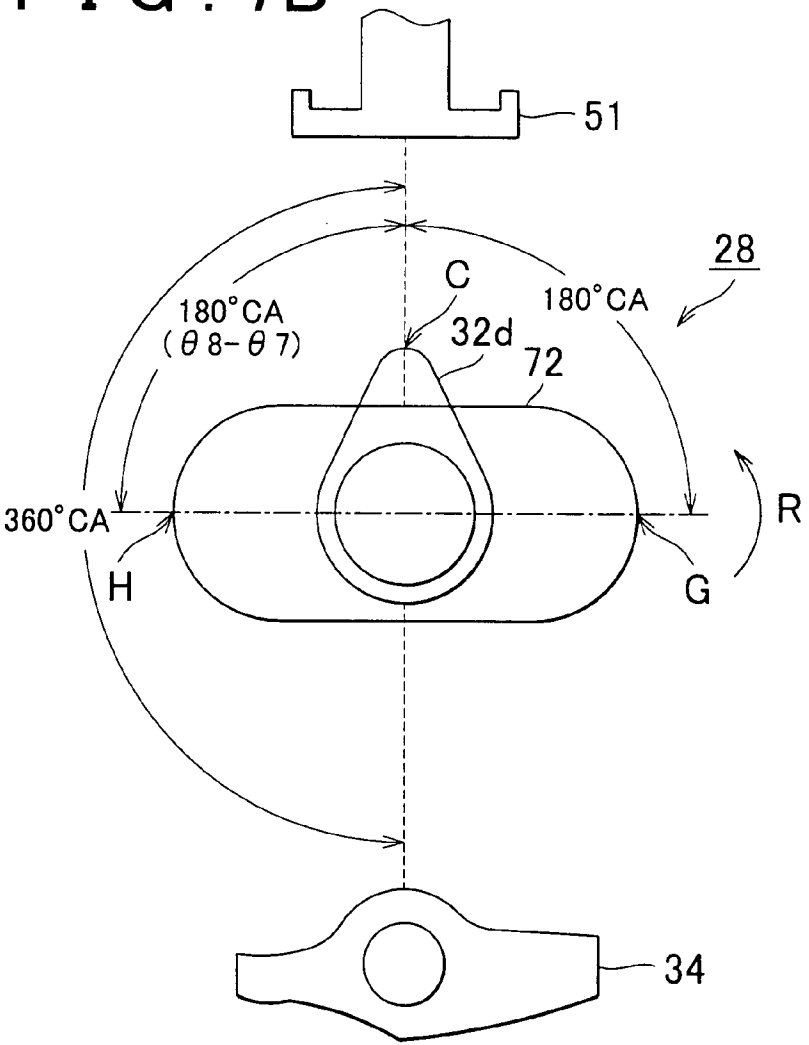
FIG. 7B is an explanatory view showing the phase of the pump cam relative to the valve cam on an intake camshaft of the right bank in the second embodiment.
Figure 7A:
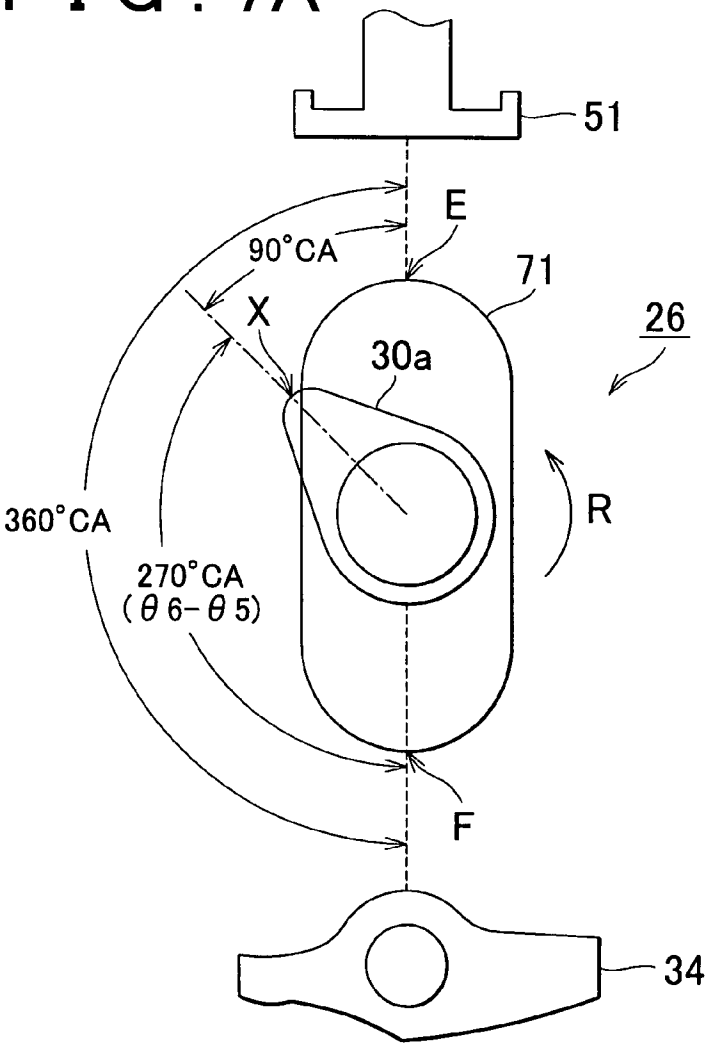
FIG. 7A is an explanatory view showing the phase of the pump cam relative to the valve cam on an intake camshaft of the left bank in a second embodiment of the invention.

In the valve system of the V-type engine 1 according to the second embodiment, a pump cam 71 formed on the first intake camshaft 26 and a pump cam 72 formed on the second intake camshaft 28 rotate in opposite phase to each other (i.e., with a phase difference of 180° CA) to drive the fuel pumps 44, 45 in opposite phase to each other, in order to suppress pulsation of the fuel. As explained below, the phase of the pump cam 71, 72 is set to suppress or reduce fluctuations in torque applied to each of the intake camshafts 26, 28. FIG. 7A and FIG. 7B show the configurations of the pump cams 71, 72 on the intake camshafts 26, 28, respectively. In FIGS. 7A and 7B, the intake camshafts 26, 28 rotate in the direction of arrow R. Each of the pump cams 71, 72 has the shape of an ellipse, and two cam noses having the same shape are formed at equal intervals over the entire circumference of the pump cam 71, 72. FIG. 7A illustrates a condition in which the top E of one of the cam noses of the pump cam 71 acts on the plunger 51 of the fuel pump 44.

FIG. 7A shows the phase of the pump cam 71 for driving the fuel pump 44 of the left bank 11, relative to the plunger 51 of the fuel pump 44, one of the valve cams 30*a* and the corresponding intake rocker arm 34. The pump cam 71 is formed on the first intake camshaft 26 such that the phase θ5 in which the top E of one of the cam noses of the pump cam 71 acts on the plunger 51 is advanced by 270° CA from the phase θ6 in which the top X of the cam nose of the valve cam 30*a* acts on the intake rocker arm 34 of #1 cylinder (i.e., θ6−θ5=270° CA). With this arrangement, the top X of the valve cam 30*a* acts on the intake rocker arm 34 when the first intake camshaft 26 rotates 270° CA after the top E of the pump cam 71 acts on the plunger 51. Because the plunger 51 and the intake rocker arm 34 are positioned relative to each other to provide a difference of 360° CA between the point of action of the pump cam 71 and the point of action of the valve cam 30*a* in the direction of rotation of the intake camshaft 26, a phase difference between the top E of the pump cam 71 and the top X of the valve cam 30*a* is equal to 90° CA, as shown in FIG. 7A. The top F of the other cam nose of the pump cam 71 is formed on the side opposite to the top E such that the top F is advanced 360° CA from the top E.

FIG. 7B shows the phase of the pump cam 72 that drives the fuel pump 45 of the right bank 12, relative to the plunger 51 of the fuel pump 45, one of the valve cams 32*d* and the corresponding intake rocker arm 34. Since the pump cam 72 and the pump cam 71 rotate in opposite phase, namely, rotate with a phase difference of 180° CA, the pump cam 72 is placed in a condition as shown in FIG. 7B when the apex E of the pump cam 71 acts on the plunger 51. The pump cam 72 is formed on the second intake camshaft 28 such that the phase 07 in which the top G of one of the cam noses of the pump cam 72 acts on the plunger 51 of the fuel pump 45 is advanced by 180° CA from the phase θ8 in which the top Y of the cam nose of the valve cam 32*d* acts on the intake rocker arm 34 of #8 cylinder (i.e., θ8−θ7=180° CA). Thus, the top Y of the valve cam 32*d* acts on the intake rocker arm 34 when the second intake camshaft 28 rotates 180° CA after the top G of the pump cam 72 acts on the plunger 51. Because the plunger 51 and the intake rocker arm 34 are positioned relative to each other to provide a difference of 360° CA between the point of action of the pump cam 72 and the point of action of the valve cam 32*a* in the direction of rotation of the intake camshaft 28, a phase difference between the top G of the pump cam 72 and the top Y of the valve cam 32*d* is equal to 180° CA, as shown in FIG. 7B. The top H of the other cam nose of the pump cam 72 is formed on the side opposite to the top G such that the top H is advanced 360° CA from the top G.

Figure 8A:
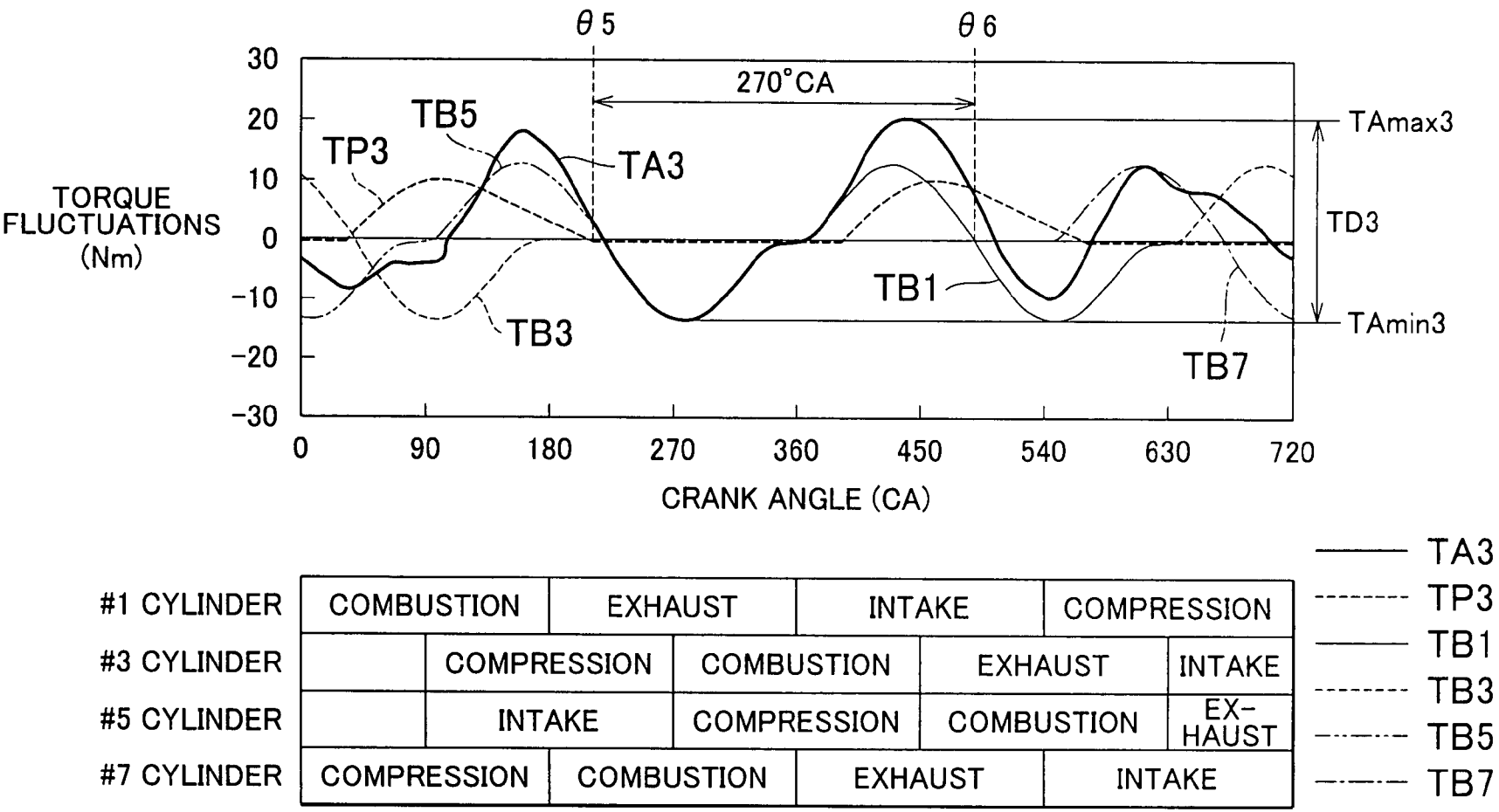
FIG. 8A is a graph indicating torque fluctuations of the intake camshaft of the left bank.
Figure 8B:
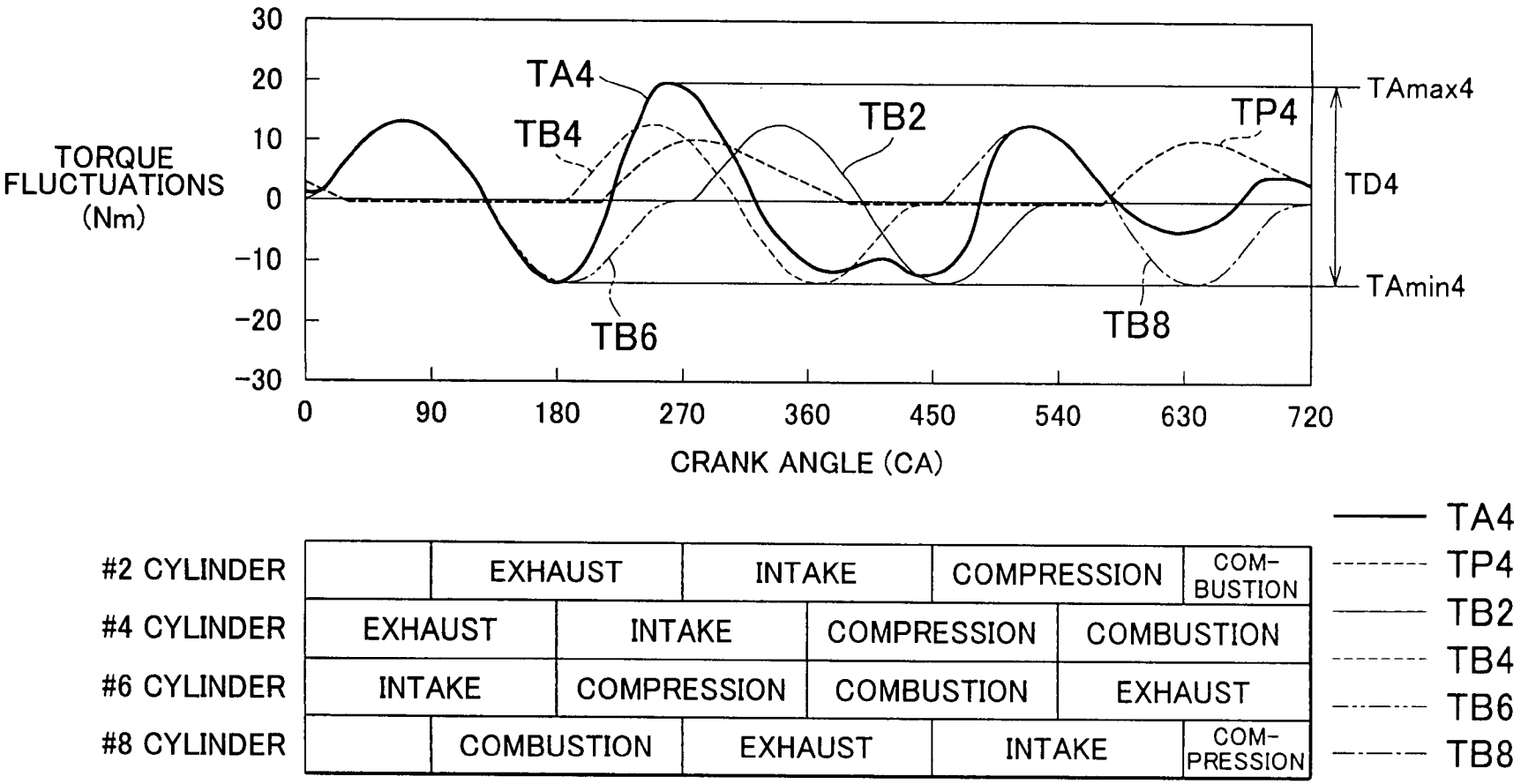
FIG. 8B is a graph indicating torque fluctuations of the intake camshaft of the right bank.

Next, torque fluctuations applied to the first intake camshaft 26 and the second intake camshaft 28 will be explained. The graphs of FIG. 8A and FIG. 8B indicate torque fluctuations (Nm) arising in the first intake camshaft 26 and the second intake camshaft 28, respectively, with respect to the crank angle (CA). In FIGS. 8A and 8B, the crank angle is equal to 0° CA when the piston of #1 cylinder is at the top dead center at which the combustion stroke starts.

FIG. 8A indicate torque fluctuations of the first intake camshaft 26. In FIG. 8A, TB1, TB3, TB5, TB7 represent torque fluctuations in driving the intake valves 22 during the intake strokes of the #1 cylinder, #3 cylinder, #5 cylinder and #7 cylinder, respectively. The driving torque fluctuations TB1, TB3, TB5, TB7 take place in substantially the same forms as those of the first embodiment.

In FIG. 8A, TP3 represents torque fluctuations in driving the fuel pump 44. The above-mentioned phase θ6 in which the top X of the cam nose of the valve cam 30*a* of #1 cylinder acts on the intake rocker arm 34 is 480° CA in the example of FIG. 8A, and, therefore, the phase θ5 in which the top E of one of the cam noses of the pump cam 71 acts on the plunger 51 is 210° CA, which is advanced 270° CA from the phase θ6. Thus, the two cam noses of the pump cam 71 start acting on the plunger 51 at 30° CA and 390° CA, respectively, and the tops E, F of the cam noses act on the plunger 51 at 210° CA and 570° CA, respectively. Namely, the periods corresponding to the pressure-feed stroke of the fuel pump 44 for feeding the fuel under pressure for delivery are between 30° CA and 210° CA and between 390° CA and 570° CA, and the remaining periods correspond to the intake stroke of the fuel pump 44 in which the fuel is drawn into the fuel pump 44. The driving torque for the fuel pump 44 varies on the positive side (i.e., increases by varying degrees) while its fluctuations TP3 assume the shape of a hill in the period of 30° CA to 210° CA and the period of 390° CA to 570° CA, and the torque fluctuation TP3 is substantially equal to zero in the remaining periods. In the example of FIG. 8A, the maximum value of the driving torque fluctuations TP3 is about 60% of the maximum values of the driving torque fluctuations TB1, TB3, TB5 and TB7.

In FIG. 8A, TA3 represents a composite of the driving torque fluctuations TB1, TB3, TB5, TB7 associated with the intake valves 22 and the driving torque fluctuations TP3 associated with the fuel pump 44. Through two revolutions (720° CA rotation) of the crankshaft, the torque fluctuations TA3 take place in the first intake camshaft 26 while the cylinders in the left bank 11 go through the four strokes in the manner as indicated in FIG. 8A. The maximum torque TAmax3 of the torque fluctuations TA3 appears at 430° CA, and the minimum torque TAmin3 appears at 280° CA. It will be understood from the graph of FIG. 8A that the phase of the pump cam 71 relative to the valve cams 30 is set such that the crank angles at which the driving torque for the fuel pump 44 is maximized in the waveform of the driving toque fluctuations TP3 do not coincide with the crank angles at which the driving torques for the intake valves 22 are maximized in the waveforms of the driving torque fluctuations TB1, TB3, TB5, TB7. This arrangement makes reduces the maximum torque TAmax3 in the torque fluctuations TA3, and thereby reduce the amplitude TD3 of the torque fluctuations TA3, which is a difference between the maximum torque TAmax3 and the minimum torque TAmin3.

FIG. 8B shows torque fluctuations of the second intake camshaft 28. In FIG. 8B, TB2, TB4, TB6 and TB8 represent torque fluctuations for driving the intake valves 22 during the intake strokes of #2 cylinder, #4 cylinder, #6 cylinder and #8 cylinder, respectively. The driving torque fluctuations TB2, TB4, TB6 and TB8 take place in substantially the same forms as those of the first embodiment.

In FIG. 8B, TP4 represents torque fluctuations in driving the fuel pump 45. Because the pump cam 72 rotates in opposite phase to the pump cam 71, the waveform of the driving torque fluctuations TP4 is shifted, i.e., advanced by 180° CA, from that of the driving torque fluctuations TP3 as shown in FIG. 8A.

In FIG. 8B, TA4 represents a composite of the driving torque fluctuations TB2, TB4, TB6 and TB8 associated with the intake valves 22 and the driving torque fluctuations TP4 associated with the fuel pump 45. Through two revolutions (720° CA rotation) of the crankshaft, the torque fluctuations TA4 take place in the second intake camshaft 28 while the cylinders in the right bank 12 go through the four strokes in the manner as indicated in FIG. 8B. The maximum torque TAmax4 of the torque fluctuations TA4 appears at 250° CA, and the minimum torque TAmin4 appears at 180° CA. It will be understood from the graph of FIG. 8B that the phase of the pump cam 72 relative to the valve cams 32 is set such that the crank angles at which the driving torque for the fuel pump 45 is maximized in the waveform of the driving toque fluctuations TP4 do not coincide with the crank angles at which the driving torques for the intake valves 22 are maximized in the waveforms of the driving torque fluctuations TB2, TB4, TB6, TB8. This arrangement reduces the maximum torque TAmax4 in the torque fluctuations TA4, and thereby reduces the amplitude TD4 of the torque fluctuations TA4, which is the difference between the maximum torque TAmax4 and the minimum torque TAmin4.

Figure 9A:
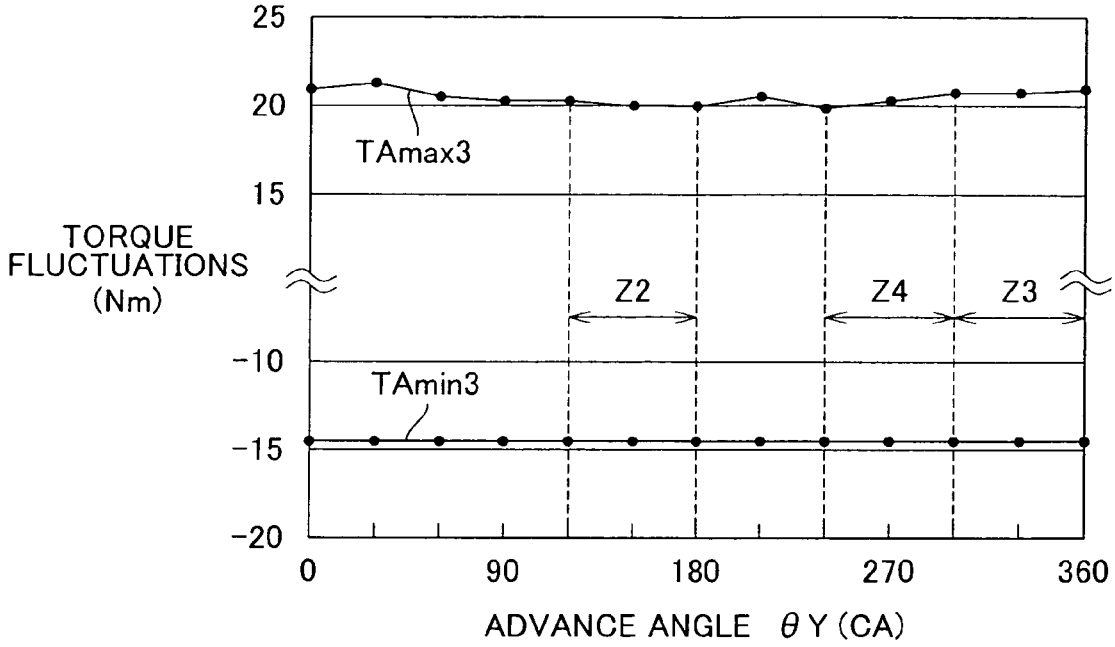
FIG. 9A is a graph indicating changes in the maximum torque and the minimum torque in the left bank with respect to the angle of advance.
Figure 9B:
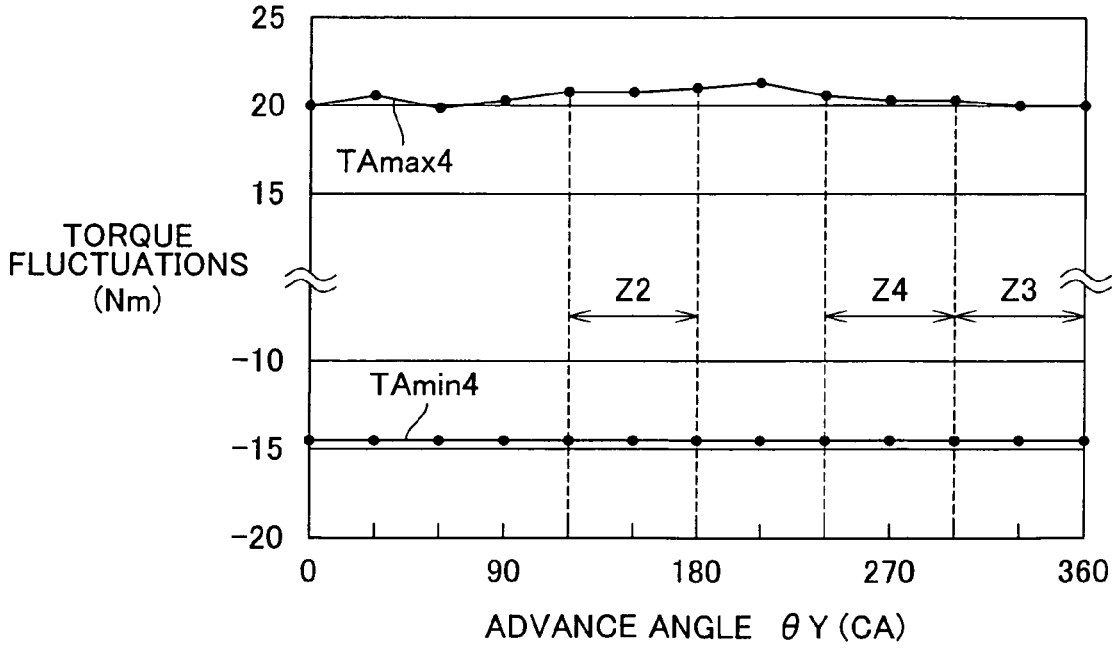
FIG. 9B is a graph indicating changes in the maximum torque and the minimum torque in the right bank with respect to the angle of advance.

The following explanation is concerned with torque fluctuations applied to the first intake camshaft 26 and second intake camshaft 28 when the phase of the pump cam 71, 72 relative to the valve cams 30, 32 is changed in the valve system of the V-type engine 1 as described above. In the illustrated embodiment, the pump cam 71 and the valve cams 30 are formed on the first intake camshaft 26 such that the above-mentioned phase θ5 is advanced 270° CA from the phase θ6. The graphs of FIG. 9A and FIG. 9B show respective changes in the maximum torques TAmax3, TAmax4 and the minimum torques TAmin3, TAmin4, which changes are observed when the phase θ5 is changed relative to the phase θ6. In FIGS. 9A and 9B, the horizontal axis indicates angle θy of advance of the phase θ5 relative to the phase θ6. As is understood from FIG. 8A and FIG. 8B, the phase of the pump cam 71, 72 changes in the cycle of 360° CA, and, therefore, FIGS. 9A and 9B show changes in the maximum and minimum torques observed when the advance angle θy varies within a range of 0° CA to 360° CA.

When the advance angle θy is in a range Z2 of 120° CA to 180° CA, the maximum torque TAmax3 takes small values, as shown in FIG. 9A, but the maximum torque TAmax4 takes large values, as shown in FIG. 9B. When the advance angle θy is in a range Z3 of 300° CA to 360° CA, on the other hand, the maximum torque TAmax4 takes small values, but the maximum torque TAmax3 takes large values. When the advance angle θy is in a range Z4 of 240° CA to 300° CA, TAmax3 and TAmax4 are well balanced with each other, and take relatively small values. Meanwhile, there is almost no change in the minimum torques TAmin3, TAmin4 with respect to the advance angle θy. Thus, when the phase θ5 is set to be advanced by 240° CA to 300° CA from the phase θ6, the maximum torques TAmax3, TAmax4 applied to the first and second intake camshafts 26, 28 can be reduced while being well balanced with each other, and the amplitudes TD3, TD4 of the torque variations TA3, TA4 can also be reduced while being well balanced with each other.

It will be understood from the above description that in the second embodiment in which the phase θ5 is set to be advanced by 270° CA from the phase θ6, the maximum torques and torque fluctuations applied to the first intake camshaft 26 and second intake camshaft 28 are advantageously reduced.

The valve system of the V-type engine according to the second embodiment of the invention provides the following advantageous effect, in addition to the effects (1), (3), (4) and (5) provided by the first embodiment.

(6) In the second embodiment, the pump cams 71, 72 rotate in opposite phase to each other, and the pump cam 71 and the valve cams 30*a* are formed on the first intake camshaft 26 such that the phase θ5 in which the top E of one of the cam noses of the pump cam 71 acts on the plunger 51 of the fuel pump 44 is advanced by 270° CA from the phase θ6 in which the top X of the cam nose of each valve cam 30*a* of #1 cylinder acts on the intake rocker arm 34. In each of the banks 11, 12, therefore, the maximum torque TAmax3, TAmax4 in the torque fluctuations TA3, TA4 of each of the intake camshafts 26, 28 can be reduced, and the amplitude TD3, TD4 of the torque fluctuations TA3, TA4 can also be reduced.

The first and second embodiments as described above may be modified as described below.

In the first embodiment, the advance angle θx by which the phase θ1 in which the top A of the pump cam 36 acts on the plunger 51 is advanced from the phase θ2 in which the top X of the valve cam 30*a* acts on the intake rocker arm 34 is set to 150° CA. However, the advance angle θx may be set to any angle within the range Z1 of 120° CA to 180° CA. If the advance angle θx is set to a certain angle within the range Z1, the maximum torque TAmax1, TAmax2 applied to each of the intake camshafts 26, 28 can be reduced, and the amplitude TD1, TD2 of the torque fluctuations TA1, TA2 can be reduced. Also, the advance angle θx is not restricted to the range Z1, but may be set to any angle with which the maximum torque TAmax1, TAmax2 is relatively small, to reduce the amplitude TD1, TD2 of the torque fluctuations TA1, TA2.

In the second embodiment, the advance angle θy by which the phase θ5 in which the top E of the pump cam 71 acts on the plunger 51 is advanced from the phase θ6 in which the top X of the valve cam 30*a* acts on the intake rocker cam 34 is set to 270° CA. However, the advance angle θy may be set to any angle within the range Z4 of 240° CA to 300° CA. If the advance angle θy is set to a certain angle within the range Z4, the maximum torque TAmax3, TAmax4 applied to each of the intake camshafts 26, 28 can be reduced, and the amplitude TD3, TD4 of the torque fluctuations TA3, TA4 can also be reduced.

While the pump cam 36, 71 and the pump cam 37, 72 are formed on the first and second intake camshafts 26, 28, respectively, in the first and second embodiments, the pump cam may be formed on each of the first and second exhaust camshafts 27, 29. Torque fluctuations in driving the exhaust valves 23, which are applied to the exhaust camshafts 27, 29, take place in forms that are phase-shifted as a whole from those of the torque fluctuations TB1-TB8 associated with the intake valves 22. Thus, if the phase of the pump cam relative to the valve cams of the exhaust valves 23 on each of the exhaust camshaft 27, 29 is set in the same manner as in the case of the intake camshafts 26, 28, torque fluctuations similar to the torque fluctuations TA1-TA4 as indicated above are applied to the exhaust camshafts 27, 29. It is thus possible to favorably suppress torque fluctuations of the exhaust camshafts 27, 29 even if the pump cams are formed on the exhaust camshafts 27, 29.

While the pump cams 36, 37, 71, 72 are arranged to drive the corresponding fuel pumps 44, 45 twice at equal time intervals while the crankshaft 17 makes two revolutions (i.e., rotates by 720° CA) in the first and second embodiments, the pump cams may be drive the corresponding fuel pumps 44, 45 three times or more during the two revolutions of the crankshaft 17. Also, it is also possible to have the pump cams 36, 37, 71, 72 drive the fuel pumps 44, 45 at equal time intervals. Even if the fuel pumps 44, 45 are driven three times or more during the two revolutions of the crankshaft 17 or at unequal time intervals, it is possible to suppress or reduce torque fluctuations TA1, TA2 of the intake camshafts 26, 28 if the crank angles at which the driving torque of the pump cams 36, 37, 71, 72 is maximized does not coincide with the crank angles at which the driving torque of the valve cams 30, 32 is maximized.

While the fuel pumps 44, 45 are disposed in the respective banks 11, 12 in the first and second embodiments, the fuel pumps 44, 45 may be replaced by a single fuel pump that driven by the first and second intake camshafts 26, 28.

While the crank-angle phase of the V-type engine 1 is shifted (namely, the four-stroke cycles of the eight cylinders in the V-type engine 1 are shifted in terms of the crank angle) in the sequence of #1 cylinder, #8 cylinder, #7 cylinder, #3 cylinder, #6 cylinder, #5 cylinder, #4 cylinder and #2 cylinder in the first and second embodiments, it may be shifted in other sequences. In this case, too, the phase of the pump cam 36, 37, 71, 72 relative to the valve cams 30, 32 may be set according to the principle of the present invention.

While the invention is applied to the V-type engine 1 having eight cylinders in the first and second embodiments, the invention is not limitedly applied to the eight-cylinder V-type engine, but may be applied to V-type engines having more cylinders.

What is claimed is:

1. A valve system of a V-type engine comprising:

a camshaft provided in each bank of the engine, formed with valve cams that open and close engine valves and a pump cam that drives a fuel pump, which feeds pressurized fuel to a fuel injection device, wherein crank-angle phase differences among cylinders in each bank of the V-type engine are set at unequal intervals; and the pump cam has a plurality of cam noses, and the phase of the pump cam relative to the valve cams is determined such that a crank angle at which driving torque of the pump cam is maximized does not coincide with a crank angle at which driving torque of each of the valve cams is maximized.

2. The valve system as defined in claim 1, wherein:

the V-type engine has four cylinders in each bank, and crank-angle phase differences between the cylinders of the engine are set at equal intervals of 90° CA, while crank-angle phase differences between the cylinders in each bank are set at unequal intervals including 90° CA and 270° CA;

the pump cam of each bank has two cam noses that are formed in the same shape at equal intervals over the entire circumference of the pump cam, and the pump cams of the two banks are arranged to drive the corresponding fuel pump in phase with each other; and the phase of the pump cam relative to the valve cams is determined in terms of the crank angle such that the phase in which a top of one of the cam noses of the pump cam acts on the fuel pump is advanced by an angle within a range of 120° CA to 180° CA from the phase in which a top of a cam nose of one of the valve cams for driving the corresponding engine valve of a specified cylinder of the engine acts on an actuator linked to the engine valve, the specified cylinder being located in the bank in which the pump cam is provided and providing a crank-angle phase difference of 270° CA with respect to the preceding cylinder in the same bank.

3. The valve system as defined in claim 1, wherein:

the V-type engine has four cylinders in each bank, and crank-angle phase differences between the cylinders of the engine are set at equal intervals of 90° CA, while crank-angle phase differences between the cylinders in each bank are set at unequal intervals including 90° CA and 270° CA;

the pump cam of each bank has two cam noses that are formed in the same shape at equal intervals over the entire circumference of the pump cam, and the pump cams of the two banks are arranged to drive the corresponding fuel pump in opposite phase to each other; and the phase of the pump cam relative to the valve cams is determined in terms of the crank angle such that the phase in which a top of one of the cam noses of the pump cam acts on the fuel pump is advanced by an angle within a range of 240° CA to 300° CA from the phase in which a top of a cam nose of one of the valve cams for driving the corresponding engine valve of a specified cylinder of the engine acts on an actuator linked to the engine valve, the specified cylinder being located in the bank in which the pump cam is provided and providing a crank-angle phase difference of 270° CA with respect to the preceding cylinder in the same bank.

4. The valve system as defined in claim 1, wherein the fuel pump is disposed in each bank, and is driven by the camshaft of each bank.

5. The valve system as defined in claim 1, further comprising a variable valve timing mechanism that changes valve timing of the engine valves by changing the phase of the valve cams relative to a crankshaft of the V-type engine, wherein:

the phase of the pump cam relative to the crankshaft is changed synchronously with a change in the phase of the valve cams relative to the crankshaft.

* * * * *